US007189137B2

(12) United States Patent
Ellman et al.

(10) Patent No.: US 7,189,137 B2
(45) Date of Patent: Mar. 13, 2007

(54) TEARING MECHANISM FOR A TOY, SUCH AS A DOLL, HAVING FIXED OR MOVABLE EYES

(76) Inventors: Steven Ellman, 1672 E. 7th St., Brooklyn, NY (US) 11230; Lawrence Mass, 5 Berkley La., Rye Brook, NY (US) 10573; Fredric Ellman, 30 Fairview Ave., Tarrytown, NY (US) 10591; Julius Ellman, 1672 E. 7th St., Brooklyn, NY (US) 11230

( * ) Notice: Subject to any disclaimer, the term of this patent is extended or adjusted under 35 U.S.C. 154(b) by 0 days.

(21) Appl. No.: 11/129,491

(22) Filed: May 16, 2005

(65) Prior Publication Data

US 2005/0255788 A1 Nov. 17, 2005

Related U.S. Application Data

(60) Provisional application No. 60/571,501, filed on May 17, 2004.

(51) Int. Cl.
*A63H 3/24* (2006.01)

(52) U.S. Cl. ..... 446/304; 446/305; 446/392

(58) Field of Classification Search ..... 446/304–306, 446/301, 392, 183, 197, 198, 341, 342, 343, 446/358

See application file for complete search history.

(56) References Cited

U.S. PATENT DOCUMENTS

| | | | |
|---|---|---|---|
| 962,154 | A | 6/1910 | Lemon |
| 1,193,947 | A | 8/1916 | Trost |
| 1,244,799 | A | 10/1917 | Trost |
| 1,255,889 | A | 2/1918 | Killy |
| 1,268,714 | A | 6/1918 | Hoefler |
| 1,280,055 | A | 9/1918 | McCrosky |
| 1,289,687 | A | 12/1918 | Davidson |
| 1,343,422 | A | 6/1920 | Thomson et al. |
| 1,395,984 | A | 11/1921 | McCrosky |
| 1,545,077 | A | 7/1925 | Watkins |
| 1,606,716 | A | 11/1926 | Munyard |
| 1,729,729 | A | 10/1929 | McCrosky |
| 2,093,684 | A | 9/1937 | Maibaum |
| 2,111,507 | A | 3/1938 | Hogan |
| 2,133,636 | A | 10/1938 | Schaeffer |
| 2,157,763 | A | 5/1939 | Konikoff et al. |
| 2,159,293 | A | 5/1939 | Schaeffer |
| 2,196,912 | A | 4/1940 | Gilbraith |
| 2,197,764 | A | 4/1940 | Marcus |
| 2,303,246 | A | 11/1942 | Wheeler |
| 2,638,710 | A | 5/1953 | Ratcliff |
| 2,675,644 | A | 4/1954 | Senior et al. |

(Continued)

FOREIGN PATENT DOCUMENTS

| | | |
|---|---|---|
| CA | 571688 | 3/1959 |

(Continued)

OTHER PUBLICATIONS

U.S. Appl. No. 11/141,310, filed Jun. 1, 2005, entitled "Expression Mechanism for a Toy, Such as a Doll, Having Fixed or Movable Eyes".

*Primary Examiner*—Kien Nguyen
(74) *Attorney, Agent, or Firm*—Dinesh Agarwal, P.C.

(57) ABSTRACT

A tearing mechanism for a toy includes a fluid chamber, a valve in operable communication with the fluid chamber for allowing or restricting the flow of a fluid from the tearing mechanism, and a motor operable in first and second generally opposite directions. The motor actuates the valve to cause tearing of the toy, when operating in only one of the first and second directions.

69 Claims, 27 Drawing Sheets

U.S. PATENT DOCUMENTS

| | | | | |
|---|---|---|---|---|
| 2,689,432 | A | | 9/1954 | Beebe |
| 2,748,530 | A | | 6/1956 | Stecker |
| 2,811,810 | A | | 11/1957 | Ostrander |
| 2,812,615 | A | | 11/1957 | Zanca et al. |
| 2,813,372 | A | | 11/1957 | Kirby |
| 2,819,560 | A | | 1/1958 | Cohn |
| 2,827,734 | A | | 3/1958 | Beebe |
| 2,838,874 | A | | 6/1958 | Brudney |
| 2,888,777 | A | | 6/1959 | Kaplan |
| 2,907,139 | A | | 10/1959 | Rekettye |
| 2,934,856 | A | | 5/1960 | Cohn |
| 2,934,857 | A | | 5/1960 | Bimbaum |
| 2,938,302 | A | | 5/1960 | Walss |
| 2,954,640 | A | | 10/1960 | Catalano et al. |
| 2,954,641 | A | | 10/1960 | Washbum |
| 2,959,890 | A | | 11/1960 | Ostrander |
| 2,961,795 | A | | 11/1960 | Baggott |
| 2,974,265 | A | | 3/1961 | Thoma |
| 2,978,833 | A | | 4/1961 | Tancredi |
| 2,987,771 | A | | 6/1961 | Catalano et al. |
| 2,990,646 | A | | 7/1961 | Berger |
| 2,994,158 | A | | 8/1961 | Washburn |
| 3,016,651 | A | | 1/1962 | Brudney |
| 3,019,551 | A | | 2/1962 | Brudney |
| 3,053,009 | A | | 9/1962 | Ostrander |
| 3,070,921 | A | | 1/1963 | Baggott et al. |
| 3,091,891 | A | | 6/1963 | Brudney |
| 3,106,040 | A | | 10/1963 | Ostrander |
| 3,193,968 | A | | 7/1965 | Brudney |
| 3,209,488 | A | | 10/1965 | Brudney |
| 3,310,908 | A | | 3/1967 | Refabert |
| 3,406,482 | A | | 10/1968 | Ryan et al. |
| 3,412,504 | A | | 11/1968 | Crosman |
| 3,444,645 | A | | 5/1969 | Tepper et al. |
| 3,445,955 | A | | 5/1969 | Ryan et al. |
| 3,477,169 | A | | 11/1969 | Gardel et al. |
| 3,571,968 | A | | 3/1971 | Samo |
| 3,758,983 | A | | 9/1973 | Cagen |
| 3,769,745 | A | | 11/1973 | Crosman |
| 3,789,539 | A | | 2/1974 | Cagen |
| 3,822,500 | A | | 7/1974 | Ostrander |
| 3,839,819 | A | | 10/1974 | Hollingsworth et al. |
| 3,841,020 | A | | 10/1974 | Ryan et al. |
| 3,855,729 | A | | 12/1974 | Sapkus et al. |
| 4,016,535 | A | | 4/1977 | Dinlocker |
| 4,033,071 | A | | 7/1977 | Strongin et al. |
| 4,050,185 | A | | 9/1977 | Terzian |
| 4,057,928 | A | | 11/1977 | Terzian |
| 4,339,889 | A | | 7/1982 | Guerrero et al. |
| 4,356,663 | A | | 11/1982 | Terzian |
| 4,560,363 | A | | 12/1985 | Garza et al. |
| 4,708,689 | A | | 11/1987 | Hou |
| 4,737,131 | A | | 4/1988 | Sirota |
| 4,740,186 | A | | 4/1988 | Sirota |
| 4,799,678 | A | | 1/1989 | Terzian et al. |
| 4,900,287 | A | | 2/1990 | Fusi et al. |
| 4,900,289 | A | | 2/1990 | May et al. |
| 5,002,514 | A | | 3/1991 | Takei |
| 5,083,962 | A | | 1/1992 | Pracas |
| 5,083,965 | A | | 1/1992 | Mayem |
| RE33,933 | E | | 5/1992 | Hou |
| 5,324,225 | A | | 6/1994 | Satoh et al. |
| 5,376,038 | A | | 12/1994 | Arad et al. |
| 5,422,628 | A | | 6/1995 | Rodgers |
| 5,746,602 | A | | 5/1998 | Kikinis |
| 5,842,902 | A | | 12/1998 | Liff |
| 5,881,679 | A | | 3/1999 | Hann |
| 5,902,169 | A | | 5/1999 | Yamakawa |
| 5,941,750 | A | | 8/1999 | Pracas |
| 6,042,450 | A | * | 3/2000 | Leversedge et al. ..... 446/304 |
| 6,068,536 | A | | 5/2000 | Madland et al. |
| 6,149,490 | A | | 11/2000 | Hampton et al. |
| 6,238,262 | B1 | | 5/2001 | Pracas |
| 6,309,275 | B1 | | 10/2001 | Fong et al. |
| 6,319,010 | B1 | | 11/2001 | Kikinis |
| 6,322,420 | B1 | | 11/2001 | Daniellian |
| 6,352,464 | B1 | | 3/2002 | Madland et al. |
| 6,358,111 | B1 | | 3/2002 | Fong et al. |
| 6,371,826 | B1 | | 4/2002 | Pestonji |
| 6,375,535 | B1 | | 4/2002 | Fong et al. |
| 6,394,872 | B1 | | 5/2002 | Watanabe et al. |
| 6,454,626 | B1 | | 9/2002 | An |
| 6,497,604 | B2 | | 12/2002 | Fong et al. |
| 6,497,606 | B2 | | 12/2002 | Fong et al. |
| 6,497,607 | B1 | | 12/2002 | Hampton et al. |
| 6,514,117 | B1 | | 2/2003 | Hampton et al. |
| 6,537,128 | B1 | | 3/2003 | Hampton et al. |
| 6,544,094 | B1 | | 4/2003 | Maddocks et al. |
| 6,544,098 | B1 | | 4/2003 | Hampton et al. |
| 6,565,407 | B1 | | 5/2003 | Woolington et al. |
| 6,599,166 | B2 | | 7/2003 | Ellman et al. |
| 6,652,349 | B1 | | 11/2003 | Wichter |
| 2001/0034180 | A1 | | 10/2001 | Fong et al. |
| 2002/0052163 | A1 | | 5/2002 | Fong et al. |
| 2002/0061700 | A1 | | 5/2002 | Chan |
| 2002/0061708 | A1 | | 5/2002 | Fong et al. |
| 2002/0086607 | A1 | | 7/2002 | Chan |
| 2002/0187722 | A1 | | 12/2002 | Fong et al. |
| 2003/0099919 | A1 | | 5/2003 | Love |
| 2004/0077272 | A1 | | 4/2004 | Jurmain et al. |
| 2004/0127140 | A1 | | 7/2004 | Kelly et al. |
| 2004/0214507 | A1 | | 10/2004 | Maddocks et al. |
| 2005/0054263 | A1 | | 3/2005 | Maar |

FOREIGN PATENT DOCUMENTS

| | | | |
|---|---|---|---|
| CA | 588684 | | 12/1959 |
| CA | 630593 | | 11/1961 |
| DE | 223397 | | 6/1910 |
| DE | 1107571 | | 5/1961 |
| DE | 2059236 | | 6/1971 |
| EP | 0104007 | A1 | 3/1984 |
| EP | 0274449 | A2 | 7/1988 |
| EP | 528092 | A1 | 2/1993 |
| EP | 529171 | A1 | 3/1993 |
| EP | 534032 | A1 | 3/1993 |
| EP | 549840 | A1 | 7/1993 |
| FR | 2081996 | | 12/1971 |
| FR | 2435273 | | 4/1980 |
| GB | 761894 | | 11/1956 |
| GB | 1258323 | | 12/1971 |
| GB | 1395589 | | 5/1975 |
| GB | 2068245 | A | 8/1981 |
| GB | 2068753 | A | 8/1981 |

* cited by examiner

FIG. 24
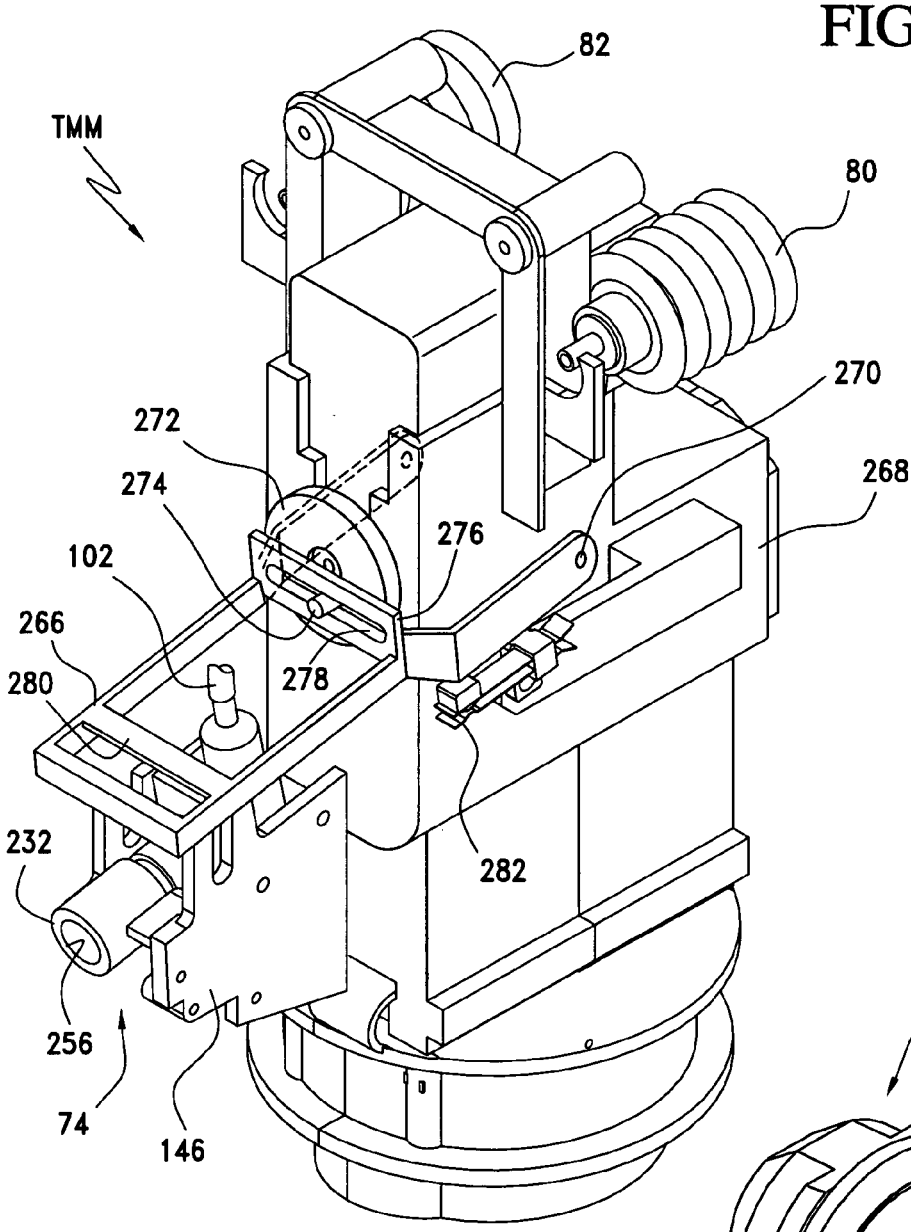
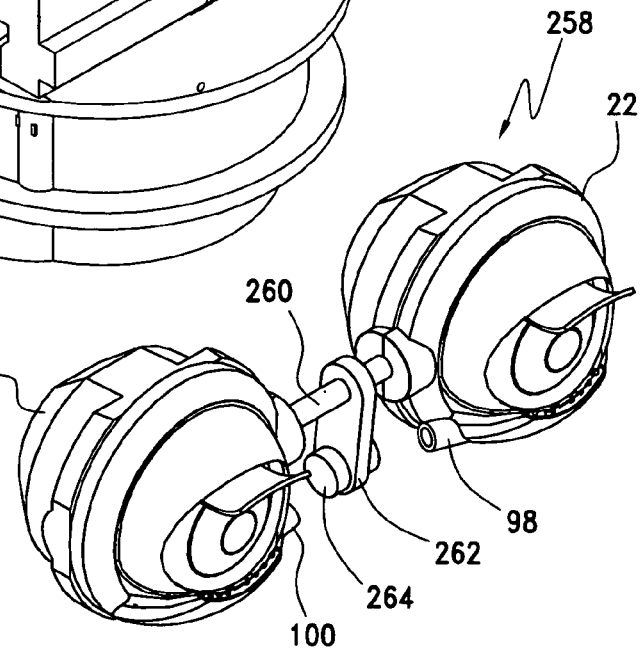
FIG. 25

TEARING MECHANISM FOR A TOY, SUCH AS A DOLL, HAVING FIXED OR MOVABLE EYES

CROSS-REFERENCE TO RELATED APPLICATIONS

The present application claims priority on prior U.S. Provisional Application Ser. No. 60/571,501, filed May 17, 2004, which is hereby incorporated herein in its entirety by reference.

FIELD AND BACKGROUND OF THE INVENTION

The present invention is generally directed to toys, and more particularly to a tearing mechanism for a toy, such as a doll, which has fixed or movable eyes.

In order to enhance playing enjoyment, use as an educational tool, or to stimulate child learning and development, the industry has provided various toys or toy figures that simulate reality. For instance, there are available varieties of dolls that simulate one or more human functions, such as tearing, crying, talking, etc.

Although many dolls are currently available that simulate tearing, they are position sensitive. In other words, in order for the doll to shed tears, the doll must be in a horizontal position. Further, in many dolls the tearing appears unnatural in that the liquid tends to flow out in small streams rather than in the natural form of tear-like drops. Finally, the conventional tearing mechanisms are bulky, complicated and occupy spaces both in the head and body of the toy, thereby making manufacturing of the dolls expensive and complicated.

Examples of various toys/tearing devices are disclosed in U.S. Pat. Nos. 962,154; 1,268,714; 1,606,716; 2,111,507; 2,157,763; 2,196,912; 2,675,644; 2,689,432; 2,748,530; 2,811,810; 2,812,615; 2,819,560; 2,827,734; 2,838,874; 2,888,777; 2,907,139; 2,934,856; 2,934,857; 2,954,640; 2,959,890; 2,961,795; 2,978,833; 2,987,771; 3,016,651; 3,019,551; 3,053,009; 3,070,921; 3,091,891; 3,106,040; 3,193,968; 3,209,488; 3,412,504; 3,444,645; 3,445,955; 3,477,169; 3,571,968; 3,758,983; 3,769,745; 3,789,539; 3,822,500; 3,839,819; 3,841,020; 3,855,729; 4,050,185; 4,057,928; 4,339,889; 4,356,663; 4,900,287; 5,002,514; 5,083,962; 5,083,965; U.S. Patent Application Publication Nos. 2004/0077272 A1; 2004/0127140 A1; 2004/0214507 A1; 2005/0054263 A1; and Foreign Patent Documents Nos. Canada 571,688; Canada 588,864; Canada 630,593; France 2,081,996; France 2,435,273; Great Britain 761,894; Great Britain 1,258,323; Great Britain 1,395,589; Great Britain 2,068,245 A; Great Britain 2,068,753 A; Germany 223,397; Germany 1,107,571; Germany 2,059,236; Europe 0,104,007 and Europe 0,274,449.

In view of the drawbacks associated with conventional tearing toys or toy figures, there is a need in the industry for a tearing mechanism which is not position sensitive, compact, and less complicated.

OBJECTS AND SUMMARY OF THE INVENTION

An object of the present invention is to provide a tearing mechanism for a toy, such as a doll, which overcomes the drawbacks of the conventional devices.

A further object of the present invention is to provide a tearing mechanism for a toy, such as a doll, which is not position sensitive.

A further object of the present invention is to provide a tearing mechanism for a toy, such as a doll, which is simple and compact in design and assembly.

A further object of the present invention is to provide a tearing mechanism for a toy, such as a doll, wherein at least one of fluid storage chambers is preferably of the type that is self-pressurized when filled with a fluid, such as bellows.

A further object of the present invention is to provide a tearing mechanism for a toy, such as a doll, wherein the entire fluid flow system is sealed off from the inner doll's head or body so that no fluid can leak into the inner doll's head or body and the inner doll's head or body remains dry.

A further object of the present invention is to provide a tearing mechanism which is controlled by a motor or manually driven linkage. The motor for the tearing mechanism is preferably controlled by a microprocessor or the like device that could be activated or deactivated by various means, such as a microphone for receiving an audible stimulus or signal, a photosensor for receiving an optical signal, an attitude switch, a shake switch, a shock switch, a pressure switch, a magnetic switch, or various other types of mechanisms, actuators, switches or the like, may be provided to activate or deactivate the microprocessor to start or stop the tearing mechanism. An example of a manually driven activation of the tearing mechanism would include twisting an arm of the doll.

A further object of the present invention is to provide a tearing mechanism for a toy, such as a doll, wherein the activation of the tearing mechanism, by a microprocessor, manually, or by a switch, causes opening of a tearing valve which allows the flow of the fluid from a pressurized chamber into a tube from the chamber, and into the inner socket of the eyes, around the eyeballs, and oozing out of the eyes through a diffuser, in tear-like drops.

A further object of the present invention is to provide a tearing mechanism for a toy, such as a doll, with fixed or movable eyes.

A further object of the present invention is to provide a tearing mechanism for a toy which is controlled manually by a switch or the like device, including an on-off switch, an attitude switch, a shock switch, a shake switch, a pressure switch, a magnetic switch, or the like.

A further object of the present invention is to provide a tearing mechanism for a toy which is controlled by a microprocessor or the like device. The microprocessor may be programmed to be activated automatically, or by an external signal, such as an audio input through a microphone, or an optical input through a photosensor.

A further object of the present invention is to provide a tearing mechanism for a toy which is controlled by a manually driven linkage.

A further object of the present invention is to provide a doll with fixed and tearing eyes.

A further object of the present invention is to provide a doll with movable and tearing eyes.

A further object of the present invention is to provide a doll with movable and tearing eyes wherein the opening or closing of the eyes is controlled by a motor driven linkage.

A further object of the present invention is to provide a doll with movable and tearing eyes wherein the opening or closing of the eyes is controlled by a manually driven linkage.

A further object of the present invention is to provide a doll with movable and tearing eyes wherein the opening or closing of the eyes is controlled by gravity.

A further object of the present invention is to provide a doll with movable and tearing eyes wherein the opening or closing of the eyes is controlled by a magnetic mechanism.

In summary, the main object of the present invention is to provide a tearing mechanism for a toy, such as a doll, with fixed or movable eyes, which is controlled mechanically by a switch or the like device, automatically by a microprocessor or the like device, or manually by a linkage or the like mechanism. The opening or closing of the eyes is controlled by a motor driven linkage, a manually driven linkage, or by gravity, and the tearing mechanism is not position sensitive. (The term "toy" as used in the present disclosure, includes, but not limited to, toys, toy figures, figures, and the like.)

At least one of the above objects is met, in part, by the present invention, which in accordance with one aspect includes a tearing mechanism for a toy, including a fluid chamber, a valve in operable communication with the fluid chamber for allowing or restricting the flow of a fluid from the tearing mechanism, a motor operable in first and second generally opposite directions, wherein the motor is in operable engagement with the valve for actuating the valve in only one of the first and second directions.

In accordance with another aspect of the present invention, a tearing mechanism for a toy includes a fluid chamber, a valve in operable communication with the fluid chamber for allowing or restricting the flow of a fluid from the tearing mechanism, an eye lever for opening or closing an eye, a motor for actuating one of the valve and the eye lever, a valve lever including a first end in operable engagement with the motor and a second end in operable engagement with the valve, wherein the eye lever includes a first end in operable engagement with the motor and a second end in operable engagement with the eye.

In accordance with another aspect of the present invention, a tearing mechanism for a toy includes a fluid chamber, a valve in operable communication with the fluid chamber for allowing or restricting the flow of a fluid from the tearing mechanism, a motor for actuating the valve, an eye including an opening for fluid to flow outwardly therefrom, and a gravity-controlled mechanism for opening or closing the eye.

In accordance with another aspect of the present invention, a tearing mechanism for a toy includes a fluid chamber, a valve in operable communication with the fluid chamber for allowing or restricting the flow of a fluid from the tearing mechanism, a motor for actuating the valve, an eye including an opening for the fluid to flow outwardly therefrom and a recess for receiving the fluid from the fluid chamber, and a fluid diffuser disposed in the recess for retarding the flow of fluid therethrough.

In accordance with another aspect of the present invention, a tearing mechanism for a toy includes a fluid chamber, a valve in operable communication with the fluid chamber for allowing or restricting the flow of a fluid from the tearing mechanism, a eye lever for opening or closing an eye, a motor for actuating the eye lever, the eye lever including a first end in operable engagement with the motor and a second end disposed adjacent to the eye, first and second magnetically attracting members, wherein the second end includes one of the first and second magnetically attracting members and the eye includes the other of the first and second magnetically attracting members.

In accordance with another aspect of the present invention, an eye opening or closing mechanism for a toy includes an eye lever for opening or closing an eye, a motor for actuating the eye lever, the eye lever including a first end in operable engagement with the motor and a second end disposed adjacent to the eye, first and second magnetically attracting members, wherein the second end includes one of the first and second magnetically attracting members and the eye includes the other of the first and second magnetically attracting members.

In accordance with another aspect of the present invention, a fluid dispensing mechanism for a figure includes a fluid chamber, a valve in operable communication with the fluid chamber for allowing or restricting the flow of a fluid from the dispensing mechanism, a motor operable in first and second generally opposite directions, wherein the motor is in operable engagement with the valve for actuating the valve in only one of the first and second directions.

In accordance with another aspect of the present invention, a method of causing a toy to tear includes: a) providing a tearing mechanism, including i) a fluid chamber, ii) a fluid valve in operable communication with the fluid chamber for allowing or restricting the flow of a fluid from the tearing mechanism, iii) a motor operable in first and second generally opposite directions, and iv) the motor being in operable engagement with the fluid valve for actuating the valve in only one of the first and second directions; b) supplying a fluid to the fluid chamber via a mouth valve in the toy; c) actuating the fluid valve by operating the motor in the one of the first and second directions; and d) allowing the fluid to flow out of one or both of the eyes of the toy.

BRIEF DESCRIPTION OF THE DRAWINGS

One of the above and other objects, novel features and advantages of the present invention will become apparent from the following detailed description of the preferred embodiment(s) of the invention, as illustrated in the drawings, in which:

FIG. 24 is a perspective view of the tearing mechanism of FIG. 21, shown without the eye assembly and the tear valve;

FIG. 25 is a perspective view of the eye assembly shown in FIG. 22;

It is noted herewith that the same reference numerals have been used in the present disclosure to designate the same or similar components, or features.

DETAILED DESCRIPTION OF THE PREFERRED EMBODIMENT(S) OF THE INVENTION

Figure 1:
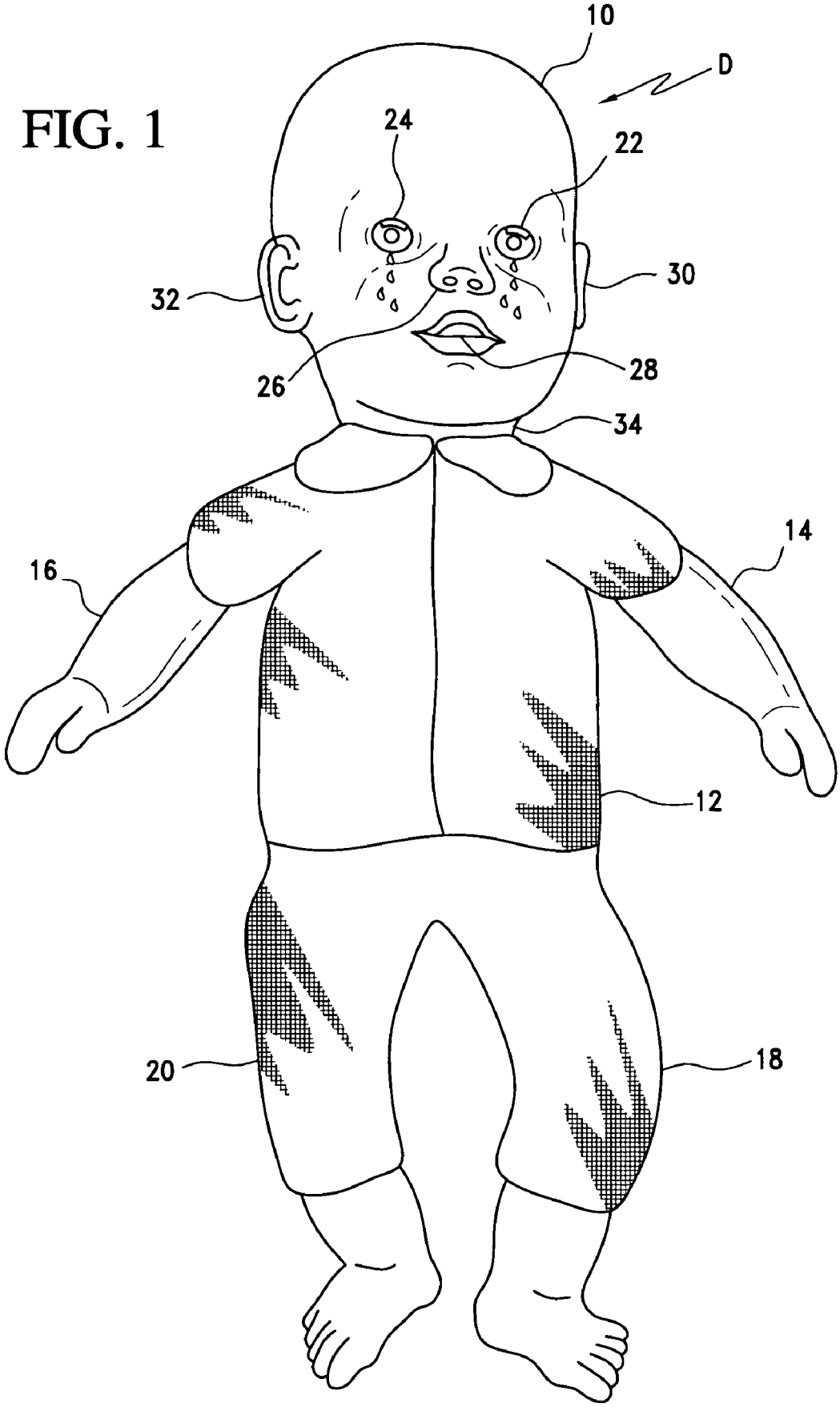
FIG. 1 is a front perspective view of a first embodiment of a toy doll in accordance with the present invention.

FIG. 1 illustrates a toy or toy figure, preferably in the form of a doll D, with a head 10, body 12 with left and right arms 14 and 16, and left and right legs 18 and 20. The head 10 includes left and right eyes 22 and 24, a nose 26, a mouth 28, and left and right ears 30 and 32. The head 10 and body are connected by a neck 34.

Figure 2:
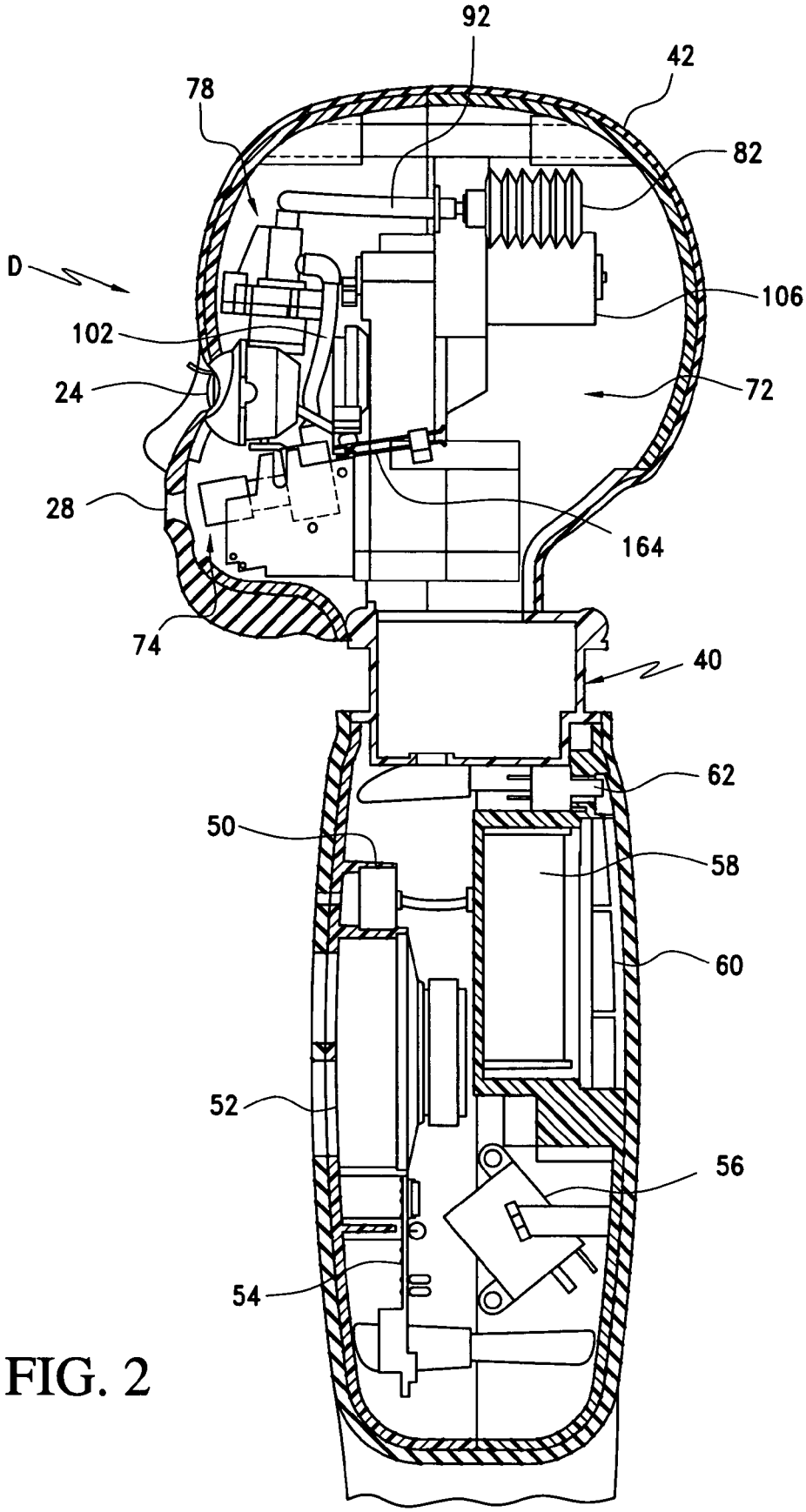
FIG. 2 is a partial side cross-sectional view of the doll shown in FIG. 1.
Figure 4:
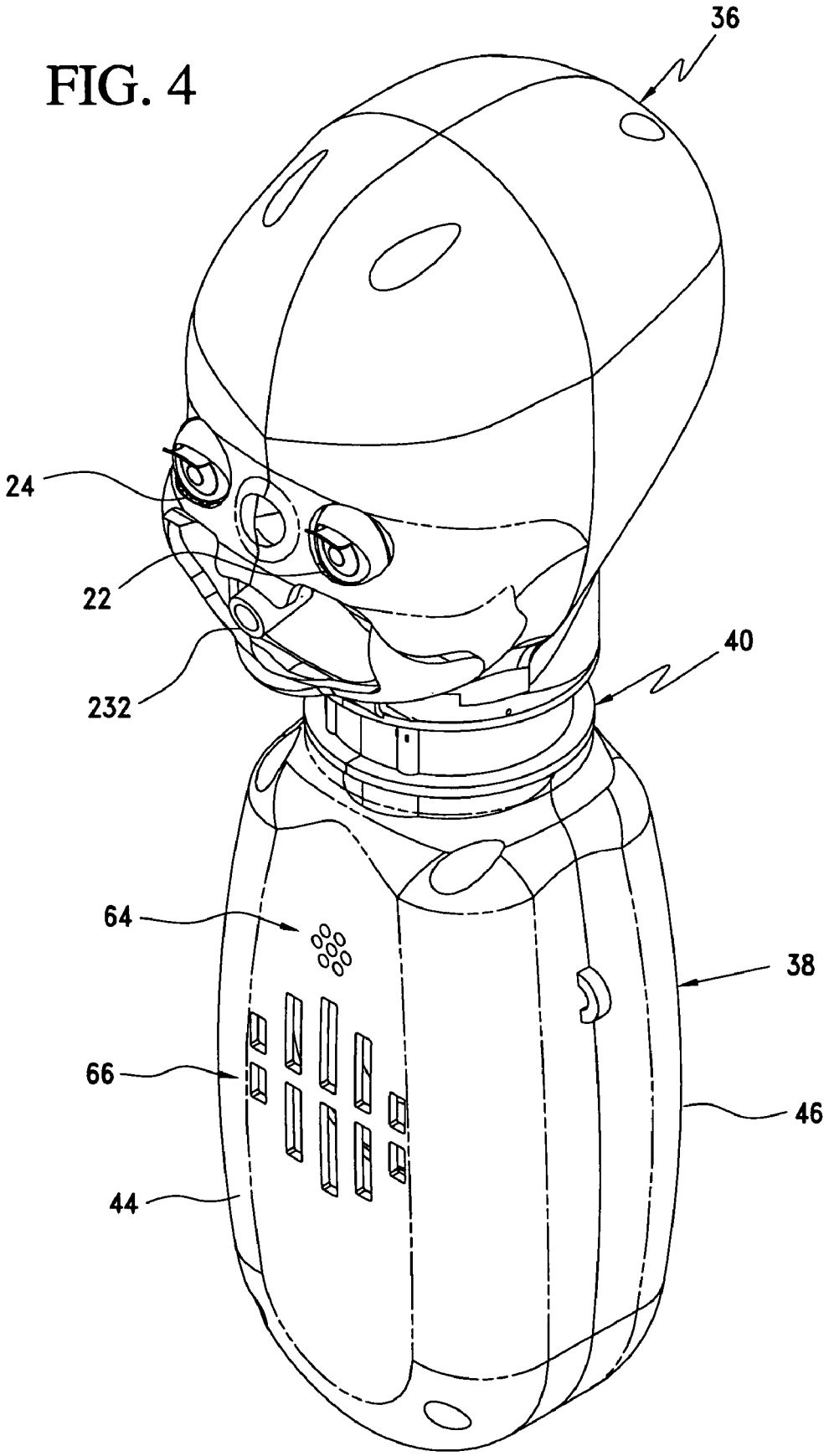
FIG. 4 is a perspective view of the head and body assemblies of the doll shown in FIG. 1.
Figure 5:
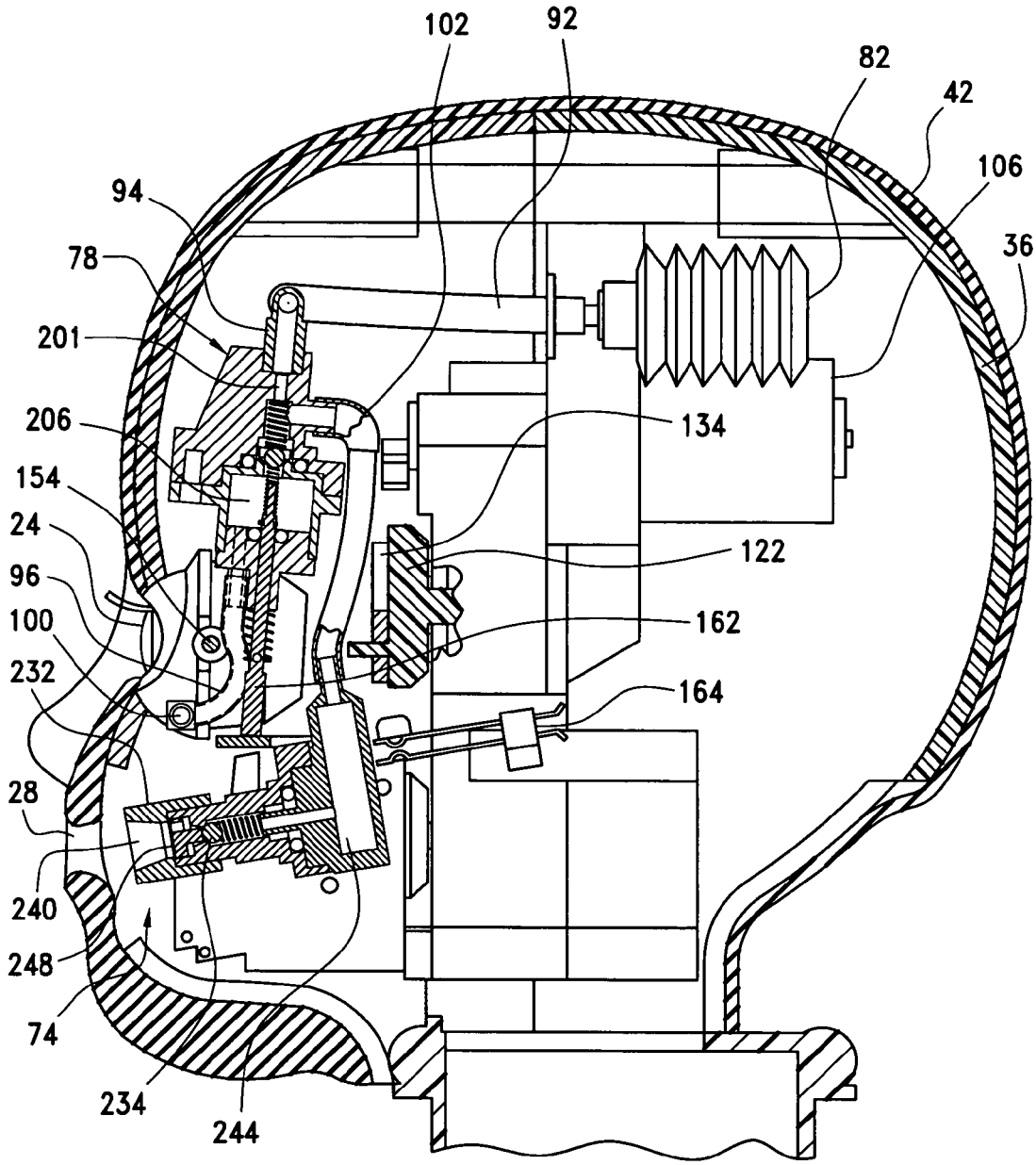
FIG. 5 is an enlarged side cross-sectional view of the head of the doll shown in FIG. 1.

As best shown in FIG. 4, the doll D includes an internal head assembly 36 and a body assembly 38 connected by a neck adapter 40. Preferably, the internal head and body assemblies 36 and 38 and the neck adapter 40, are made from a rigid plastic or the like conventional material, which is then covered by a flexible material 42 that simulates natural skin (FIG. 2).

Figure 3:
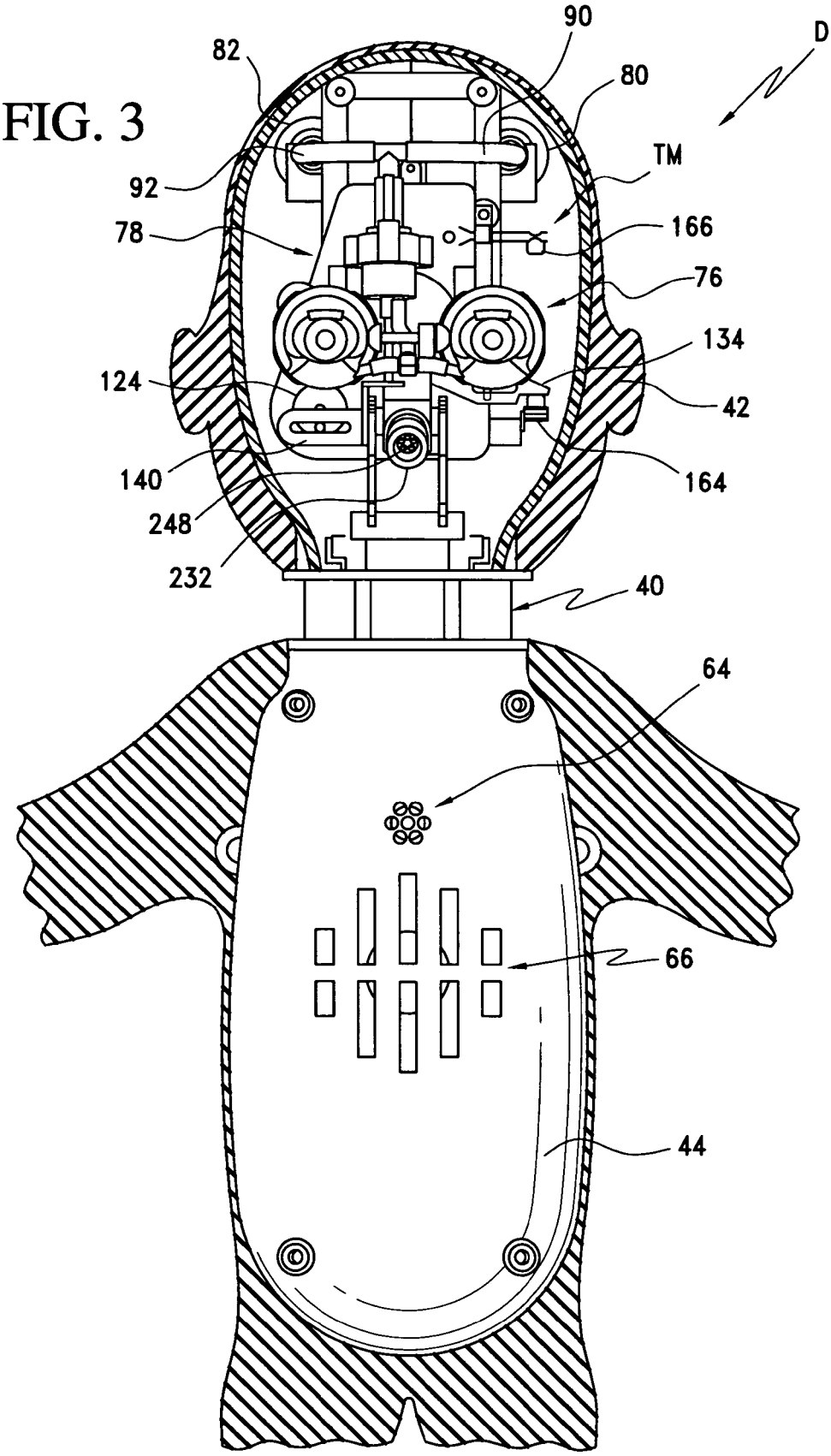
FIG. 3 is a partial front cross-sectional view of the doll shown in FIG. 1.
Figure 6:
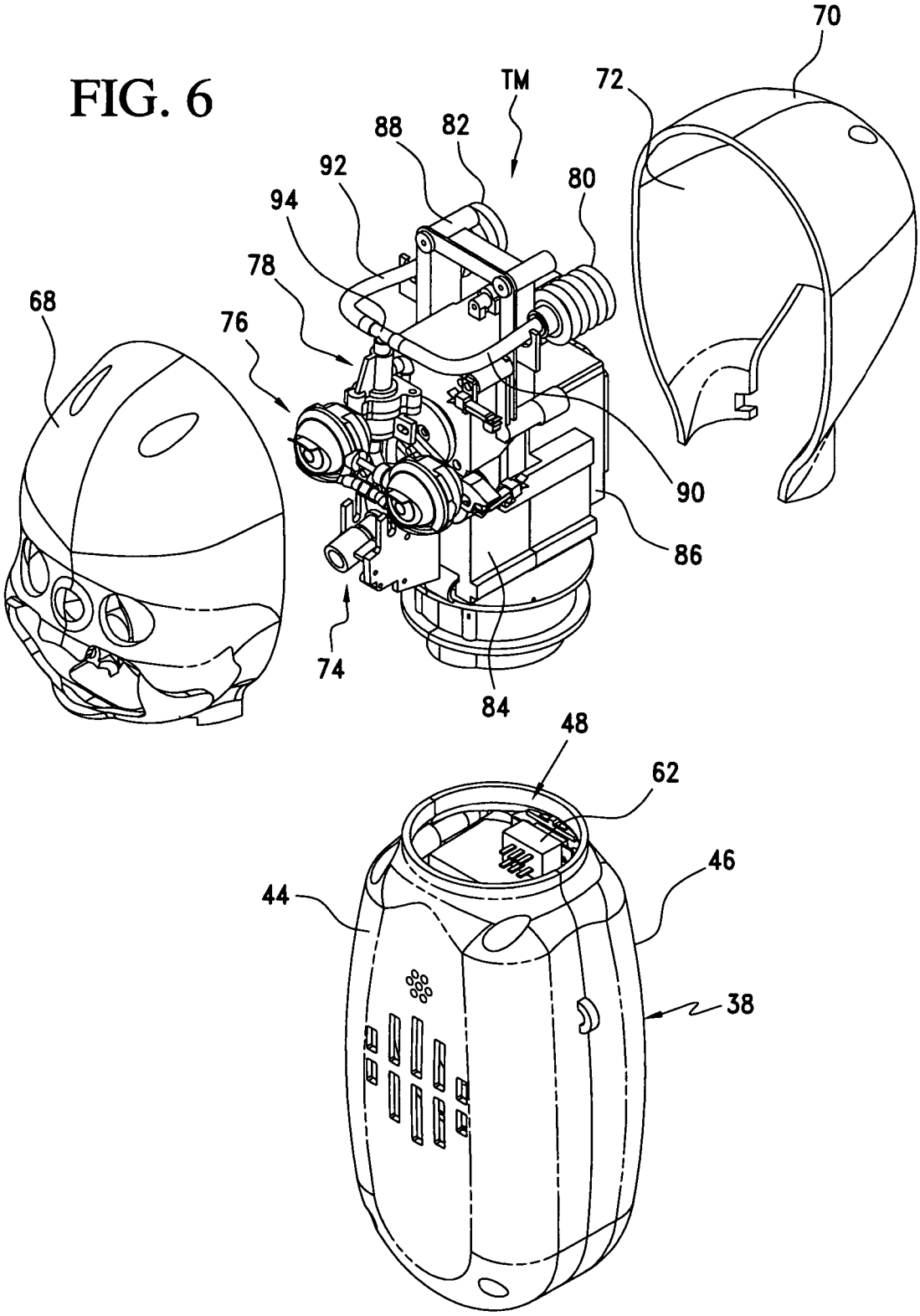
FIG. 6 is a partially exploded view of the head and body assemblies shown in FIG. 4.

As best shown in FIG. 6, the body assembly 38 includes front and rear body housings 44 and 46 connected together in a conventional manner to define an internal chamber 48. As best shown in FIG. 2, the internal chamber 48 is preferably provided with a microphone assembly 50, a speaker assembly 52, a circuit board 54, an attitude or the like switch 56, a battery compartment 58 with a cover 60, and an ON-OFF switch 62. (It is noted herewith that a different set of components may be provided to obtain different functionalities for the doll, as desired.) As best shown in FIGS. 3–4, the front body housing 44 is provided with microphone and speaker holes 64 and 66, respectively, for communication with the microphone and speaker assemblies 50 and 52.

As best shown in FIG. 6, the head assembly 36 includes front and rear head housings 68 and 70 connected together in a conventional manner to define an internal recess 72 for accommodating therein a tearing mechanism TM.

The tearing mechanism TM includes a mouth valve 74, an eye assembly 76, a tear valve 78, self-pressurizable or expandable left and right fluid storage chambers, preferably in the form of bellows 80 and 82, a gear train housing 84 and a motor housing 86. The fluid storage chambers can also be of non-bellows type that are expandable.

Figure 7:
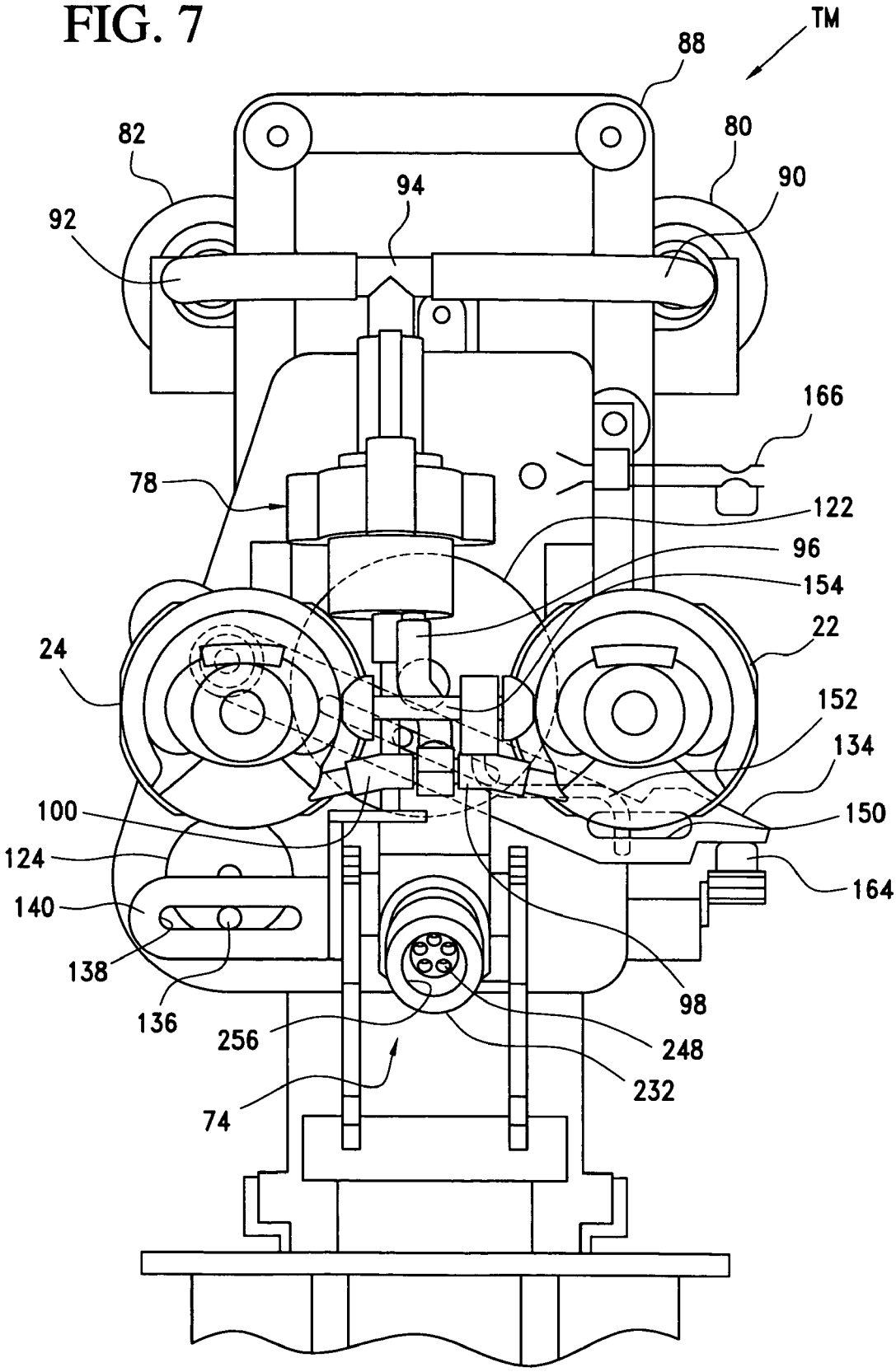
FIG. 7 is an enlarged front elevational view of a first embodiment of a tearing mechanism in accordance with the present invention.

The bellows 80 and 82 are supported on a frame 88 and supply a fluid to the tear valve 78 by corresponding left and right connector tubes 90 and 92 via a tee 94. A fluid outlet tube 96 supplies the fluid from the tear valve 78 to the left and right eyes 22 and 24 by left and right tear ducts 98 and 100, respectively (FIG. 7). A fluid inlet tube 102 feeds the fluid to the bellows 80 and 82 from the mouth valve 74 (FIGS. 5, 7–8 and 10).

Figure 12:
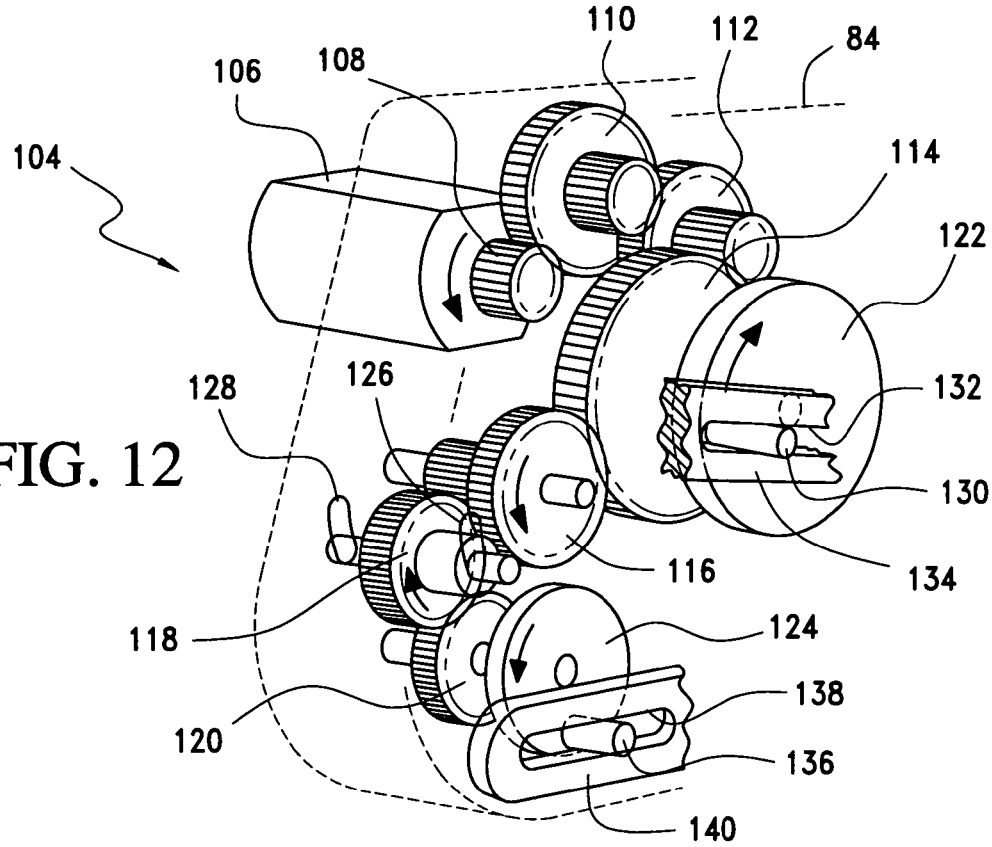
FIG. 12 illustrates operation of the motor in a counter-clockwise direction and the relationship of various gears.
Figure 13:
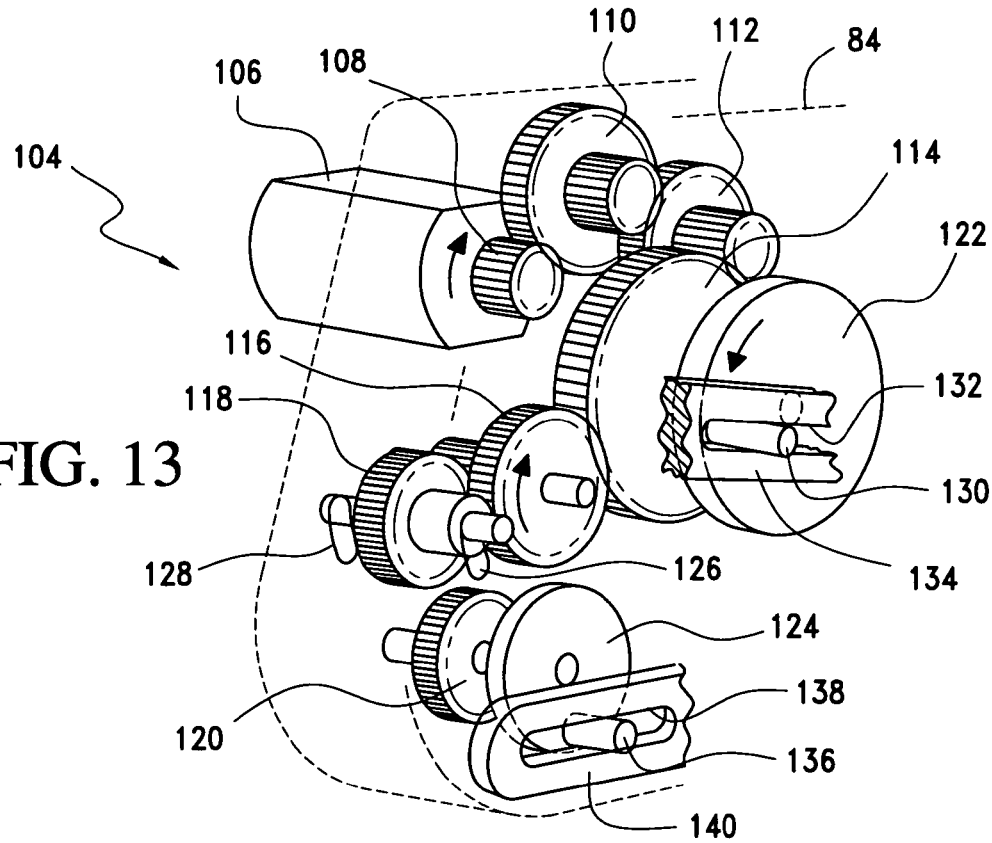
FIG. 13 illustrates operation of the motor in a clockwise direction and the relationship of various gears.

Referring now to FIGS. 12–13, the motor and gear assembly 104 will now be described. As illustrated, a conventional motor 106 includes a pinion gear 108 in intermeshing engagement with reduction gears 110 and 112, and a cam gear 114. The cam gear 114 is, on the other hand, in intermeshing engagement with a reduction gear 116, a toggle gear 118, and a cam gear 120. The cam gears 114 and 120 include cams 122 and 124, respectively.

The toggle gear 118 is mounted in slightly curved front and rear slots 126 and 128 in the gear train housing 84 in a manner that it is in intermeshing engagement with the cam gear 120 when the motor 106 turns counterclockwise (FIG. 12) and is out of engagement with the cam gear 120 when the motor 106 turns in a clockwise direction (FIG. 13).

The cam 122 includes a pin 130 that is in sliding engagement with a slot 132 in an eye lever 134. Likewise, the cam 124 includes a pin 136 which is in sliding engagement with a slot 138 in a tear valve lever 140 (FIGS. 11–13).

Figure 11:
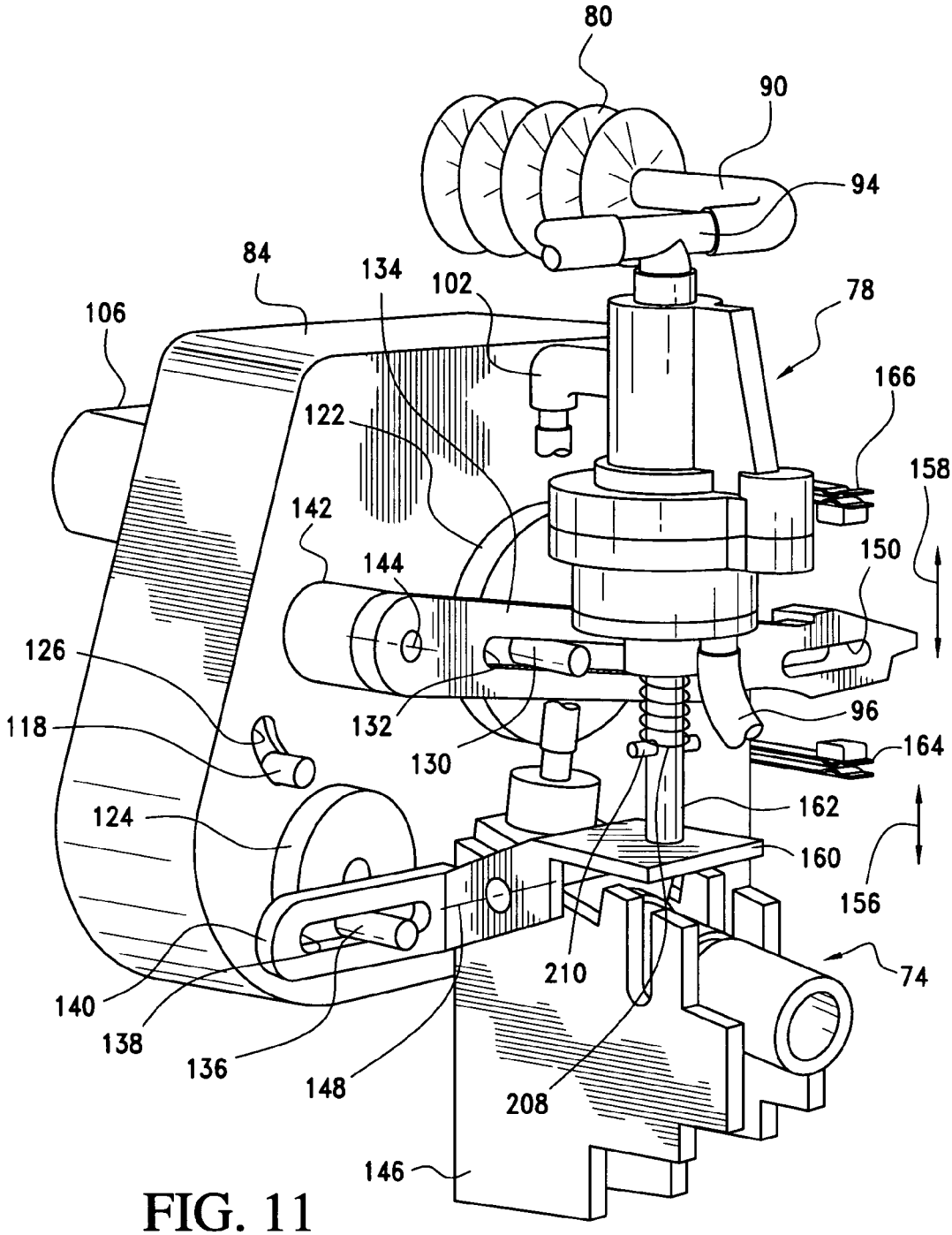
FIG. 11 is a partial enlarged view taken in the direction of arrow 11 in FIG. 10, shown with the tear valve.

As best shown in FIG. 11, the eye lever 134 is cantilevered on the gear train housing 84 at 142 and pivots vertically about an horizontal axis 144. Likewise, the tear valve lever 140 is pivotally mounted on a support block 146 and see-saws about an horizontal axis 148. The eye lever 134 further includes an end slot 150 for slidably receiving an eye actuator arm 152 which is rigidly mounted to a shaft 154 connecting the eye balls of the left and right eyes 22 and 24 (FIGS. 9, 11, 30, 32 and 33). The tear valve lever 140 includes an actuator plate 160 which is in engagement with a tear valve actuator pin 162 (FIG. 11).

From the arrangement illustrated in FIGS. 12–13, one would appreciate that when the motor 106 turns in a counterclockwise direction (FIG. 12), the toggle gear 118 would slip down in the slots 126 and 128 to engage the cam gear 120 thereby turning the cam 124. This would cause the pin 136 of the cam 124 to translate in the slot 136 and cause the tear valve lever 140 to pivot or see-saw about the horizontal axis 148, thereby moving the tear valve actuator plate 160 up and down (see arrow 156 in FIG. 11). As further described below, moving the actuator pin 162 up and down would cause the tear valve 78 to open and close, thereby allowing the fluid to flow down via the fluid outlet tube 96. Likewise, when the motor 106 turns in a clockwise direction (FIG. 13), the toggle gear 118 would slip up and out of engagement with the cam gear 120 leaving the cam 124 in an idle position. As a result, the tear valve lever 140 would not pivot about the axis 148 and the tear valve 78 would not operate and no fluid would flow out via the fluid outlet tube 96.

One would further appreciate that since the gears 108, 110, 112 and 114, always remain in intermeshing engagement, the cam gear 114 would turn regardless of the motor 106 turning clockwise or counterclockwise, thereby causing the pin 130 of the cam 122 to translate in the slot 132. This would cause the eye lever 132 to pivot up and down about the axis 144 causing the eye actuator arm 152 to move up and down (see arrow 158 in FIG. 11). The up and down movement of the eye actuator arm 152 would cause the eyes to open and close, as further described below.

The up and down movement of the eye lever 134 is limited and detected by contact switches 164 and 166, which communicate to the motor 106 open and closed positions of the eyes, respectively (FIGS. 8–11).

Figures 30, 31:
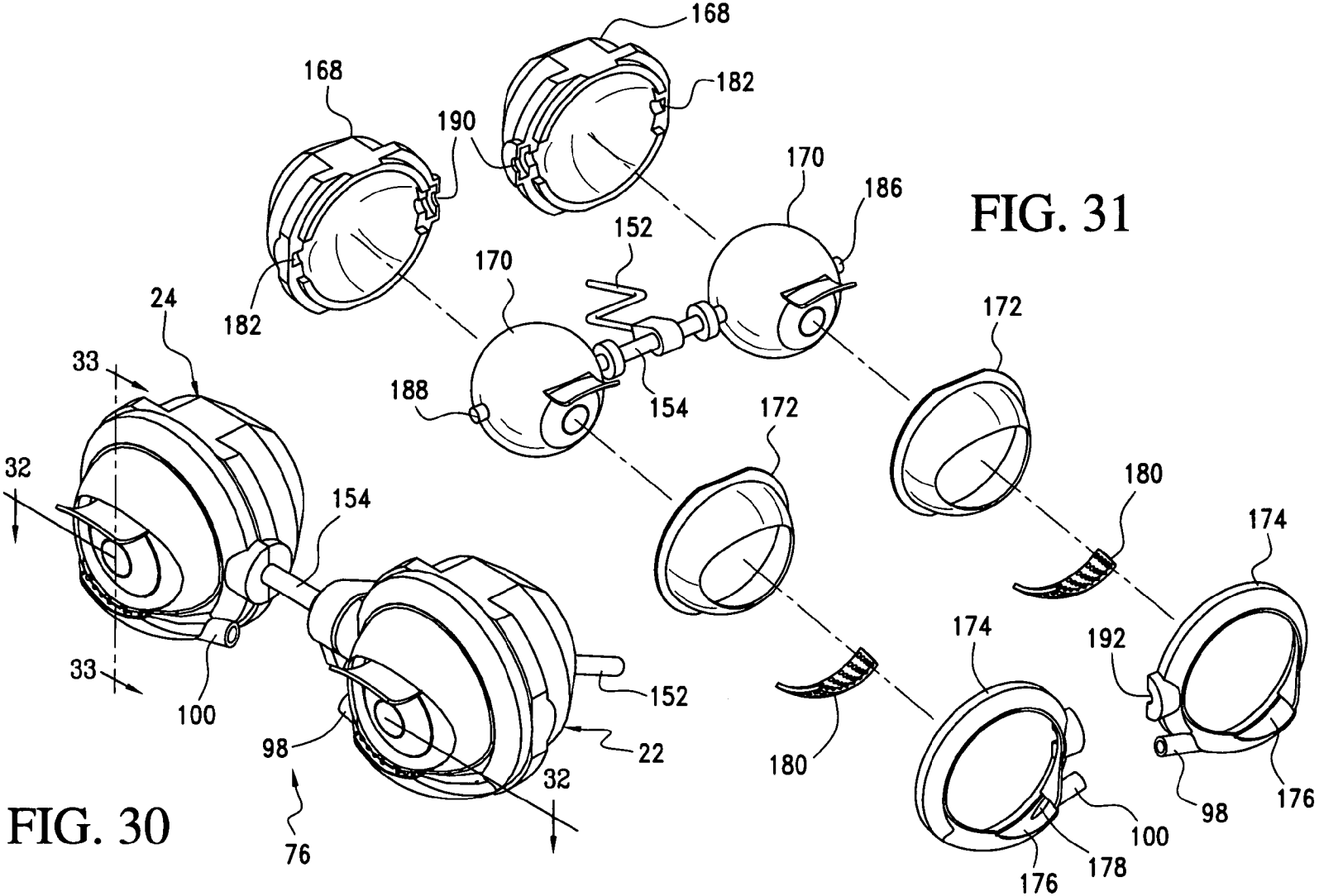
FIG. 30 is a perspective view of the eye assembly of the first embodiment of the tearing mechanism shown, for example, in FIGS. 6–9.
FIG. 31 is an exploded view of the eye assembly shown in FIG. 30.
Figure 32:
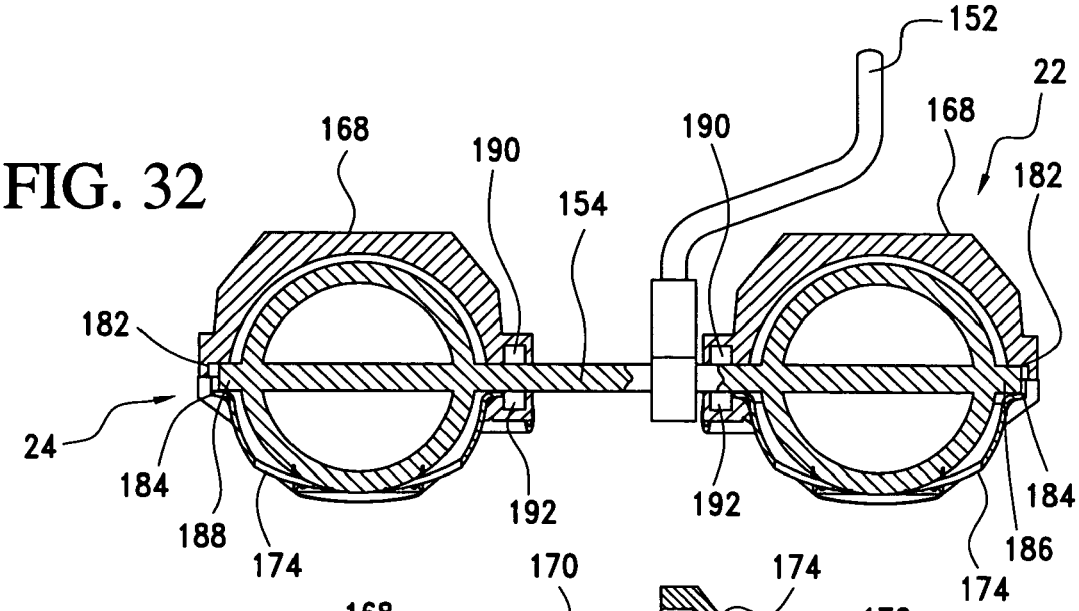
FIG. 32 is a sectional view taken along line 32—32 of FIG. 30.
Figure 33:
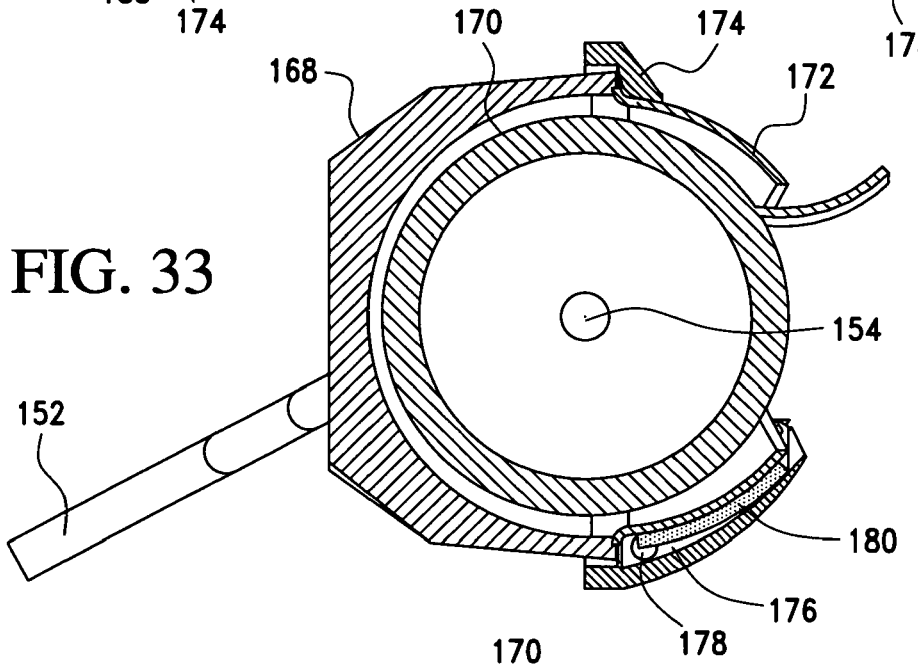
FIG. 33 is a sectional view taken along line 33—33 of FIG. 30.

Referring to FIGS. 31–33, the eye assembly 76 will now be described. As best shown in FIGS. 30–31, the eye assembly 76 includes left and right eyes 22 and 24, each having an eye ball socket 168 for rotatably accommodating therein an eyeball 170. An eye cap 172 and a tear cap 174 are fitted over the eyeball 170 and snapped onto the eyeball socket 168 to complete the eye. As best shown in FIG. 33, the eye cap 172 and the tear cap 174 define therebetween and adjacent the corresponding lower region of each of the eyes 22 and 24, a fluid recess 176 for receiving the fluid supplied by the corresponding tear ducts 98 and 100 via an opening 178. A fluid diffuser 180 is provided in the recess 176 for slowing or retarding the flow of the fluid therein. Although it is preferable that the diffuser 180 be made of an open cell or porous foam material, other suitable material or structures may also be used for this purpose.

As best shown in FIGS. 31–32, the eyeball socket 168 and the tear cap 174 include end notches 182 and 184, respectively, to accommodate ends 186 and 188 of the shaft 154. The eyeball socket 168 and the tear cap 174 further include center notches 190 and 192, respectively, for receiving the center portion of the shaft 154. This construction allows the left and right eyeballs 170 to rotate relative to the eyeball socket 168 and the eye and tear caps 172 and 174, to simulate opening or closing of the eyes 22 and 24 when the eye actuator arm 152 is moved up or down by the eye lever 134.

Figure 34:
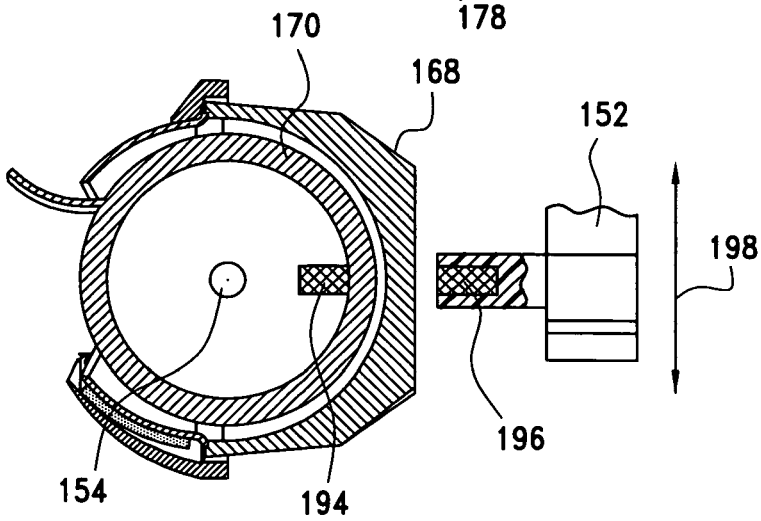
FIG. 34 is a view similar to FIG. 33, showing an alternative embodiment of the eye assembly.

FIG. 34 illustrates an alternative embodiment of the eye assembly, where the eyes open and close by magnetic induction. As shown, two magnetically attracting members 194 and 196 are provided. More specifically, the magnetically attracting member 194 is mounted preferably on the inside and towards the back of the eyeball socket 168. The other magnetically attracting member 196 is provided at the end of the eye actuator arm 152. Therefore, when the eye actuator arm 152 moves up or down relative to the eyeball socket 168 (see arrow 198 in FIG. 34), the eyeball 170 would also move up or down due to the magnetic forces between the magnetically attracting members 194 and 196. This would result in opening or closing of the eyes.

The magnetically attracting members 194 and 196 may both be conventional magnets with opposite poles, or one of them may be a metallic piece.

Figure 35:
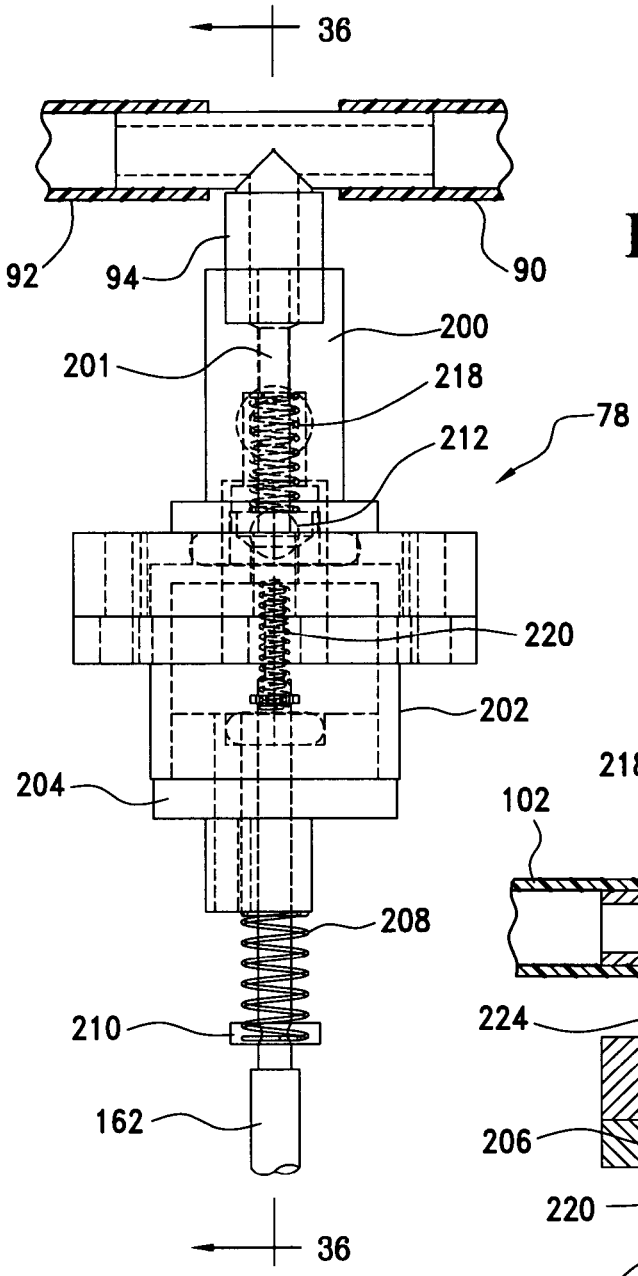
FIG. 35 is an enlarged elevational view of the tear valve.
Figure 36:
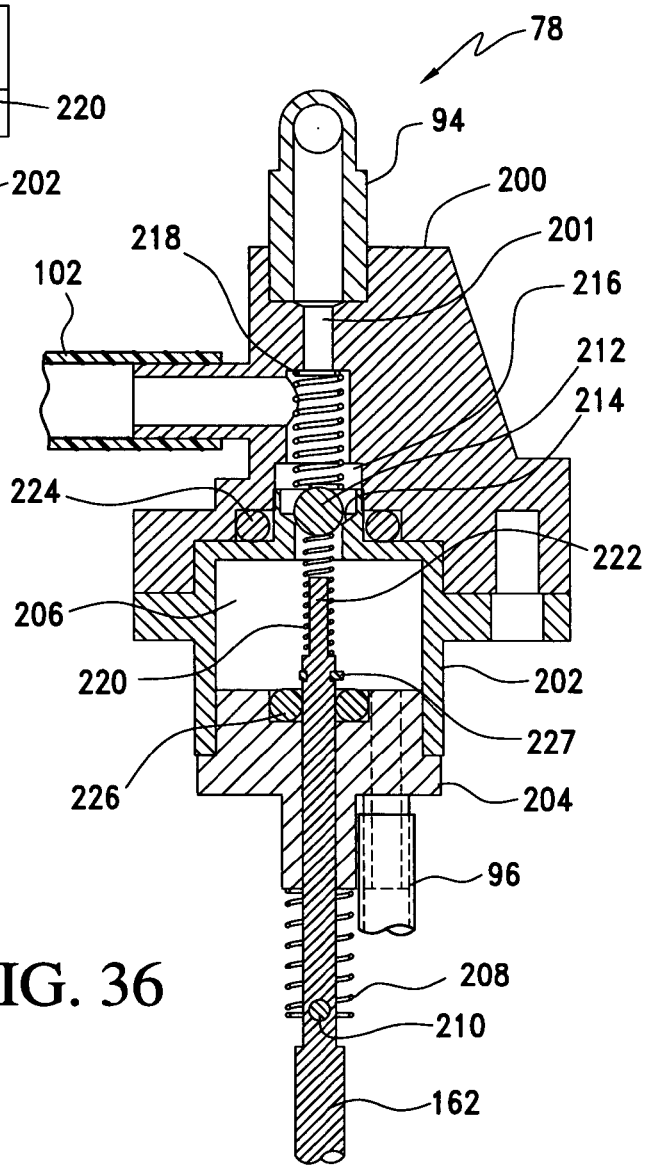
FIG. 36 is a sectional view taken along line 36—36 of FIG. 35.

Referring to FIGS. 35–36, the tear valve 78 will now be described. As shown, the tear valve 78 includes a top housing 200, a body 202, and a bottom housing 204. The body 202 and the bottom housing 204 define therebetween a recess 206 for receiving the fluid supplied by the left and right connector tubes 90 and 92 via the tee 94. The tear valve actuator pin 162 is biased on the outside against the bottom housing 204 by a return spring 208 and a stop pin 210. A ball valve 212 is positioned in an opening 214 between the fluid recess 206 and the fluid chamber 216 in the top housing 200. The ball valve 212 is biased between upper seal and lower pusher springs 218 and 220, respectively. The lower spring 220 is positioned partially over the end portion 222 of the tear valve actuator pin 162 and is biased against thereto. An upper O-ring 224 is provided between the top housing 200 and the body 202, and a lower O-ring 226 is provided between the bottom housing 204 and the tear valve actuator pin 162, to provide a fluid-tight engagement therebetween. An E-clip 227 functions as a stop for the tear valve actuator pin 162.

The tear valve 78 is opened when the valve actuator pin 162 is moved up (by an upward force of the tear valve actuator plate 160) against the force of the spring 208, causing the ball valve 212 to unseat from the opening 214. When the upward force on the valve actuator pin 162 is released (by the tear valve actuator plate 160 moving down), the valve actuator pin 162 and the ball valve 212 return to their initial positions by the forces exerted by the return spring 208 and the pusher spring 218, respectively, thereby closing the opening 214.

Figure 8:
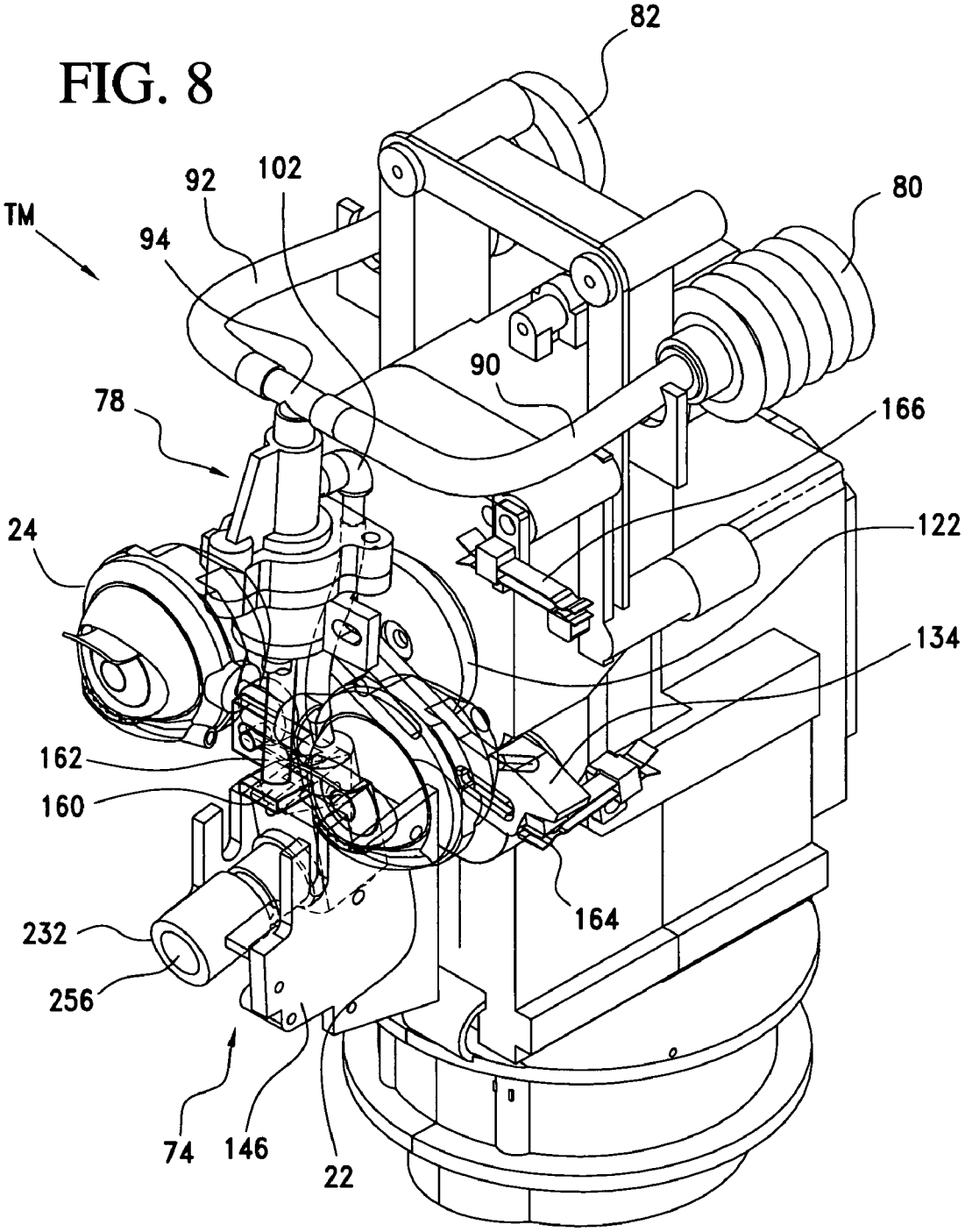
FIG. 8 is a perspective view of the tearing mechanism of FIG. 7, showing the eyes in an open position.
Figure 9:
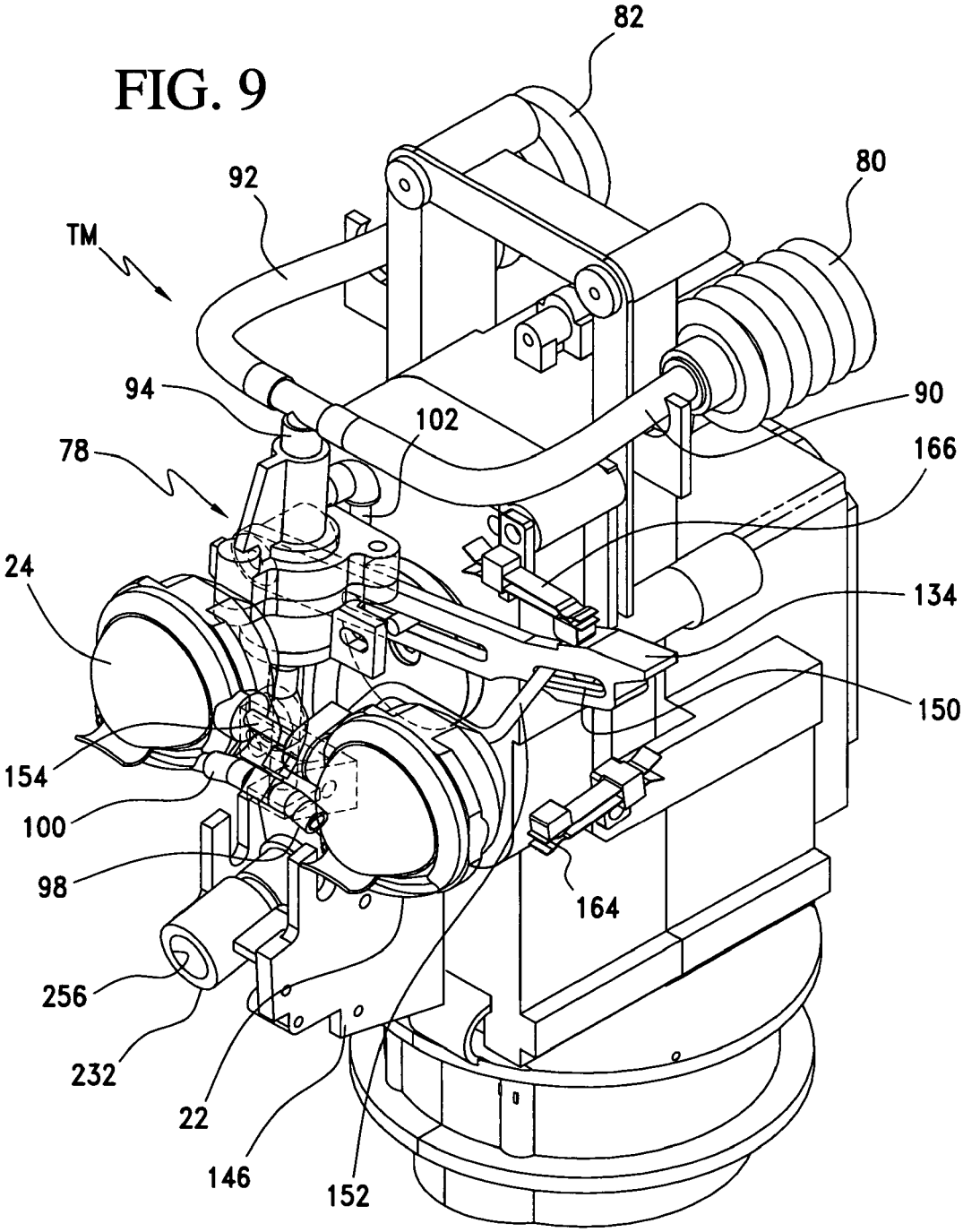
FIG. 9 is a perspective view of the tearing mechanism of FIG. 7, showing the eyes in a closed position.
Figure 10:
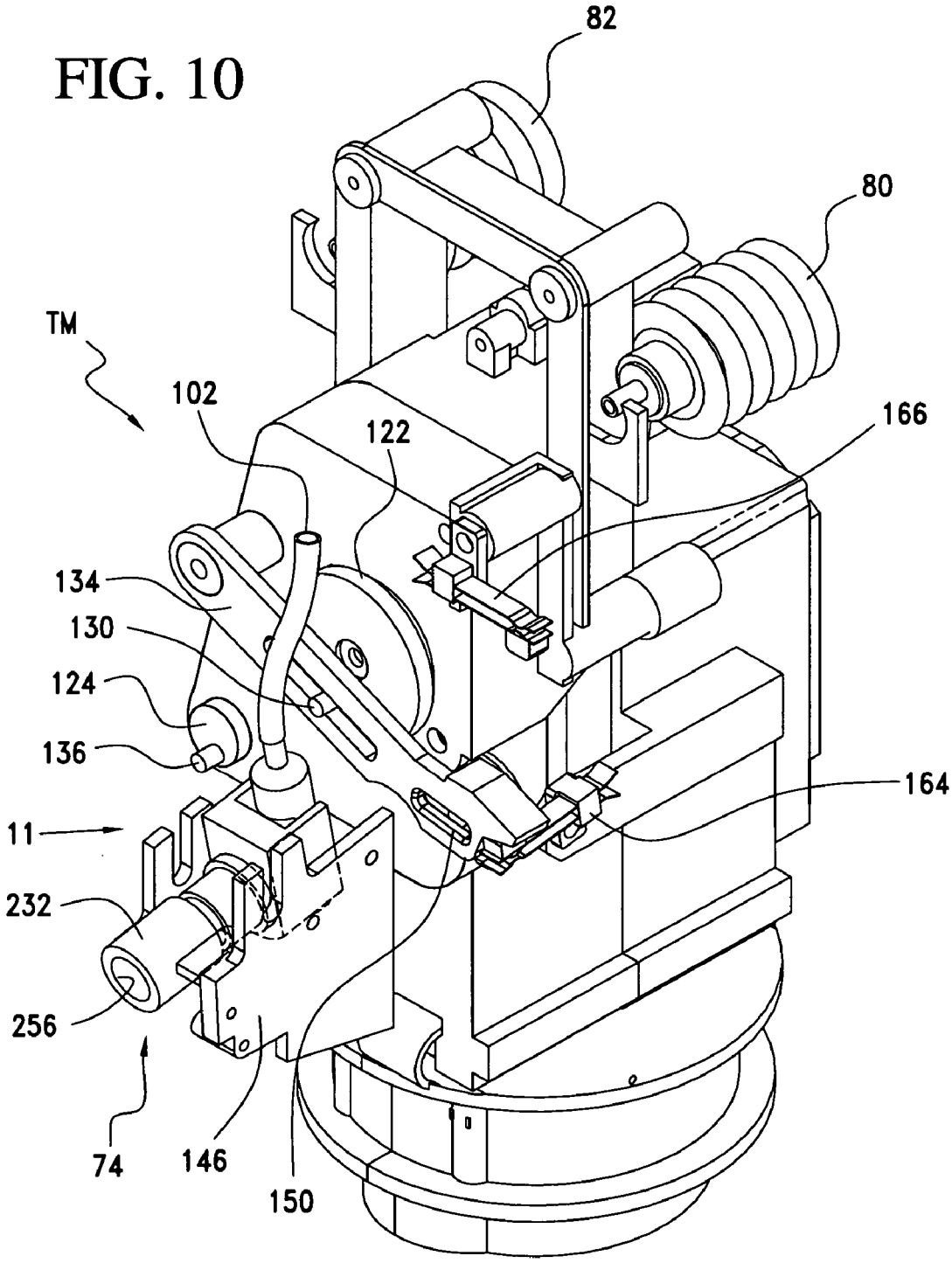
FIG. 10 is a perspective view of the tearing mechanism of FIG. 7, shown without the eye assembly and the tear valve.
Figure 37:
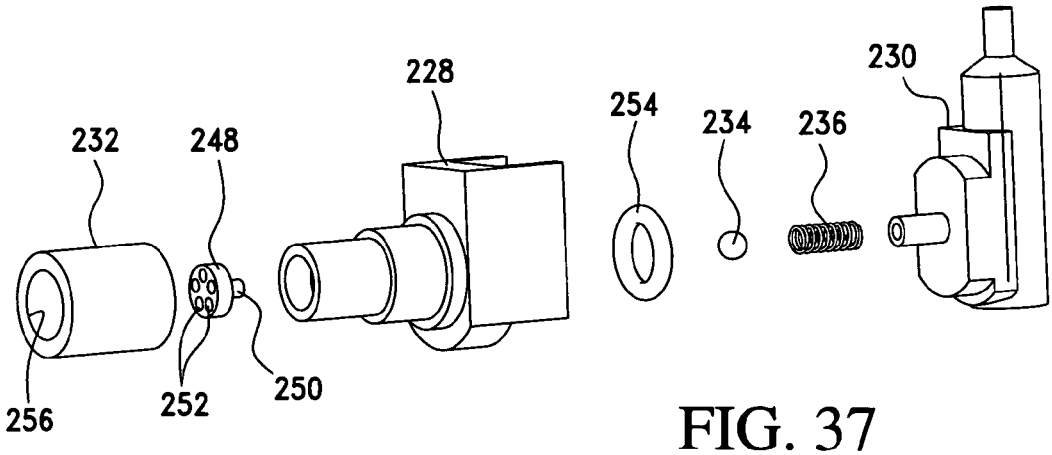
FIG. 37 is an exploded view of the one-way mouth valve.
Figure 38:
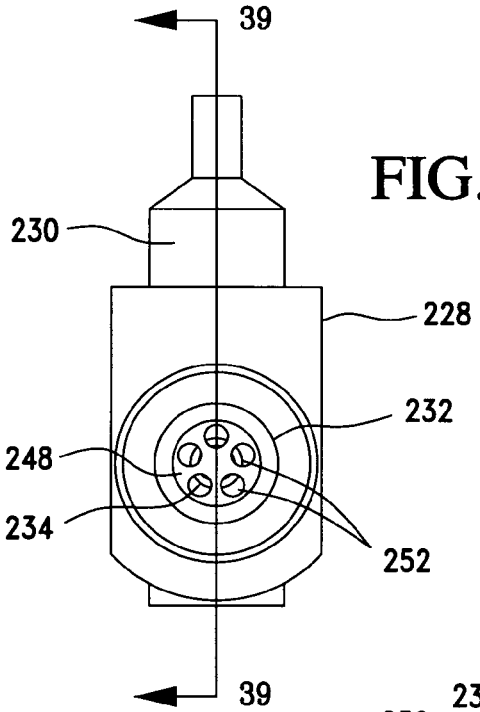
FIG. 38 is a front elevational view of the mouth valve shown in FIG. 37.
Figure 39:
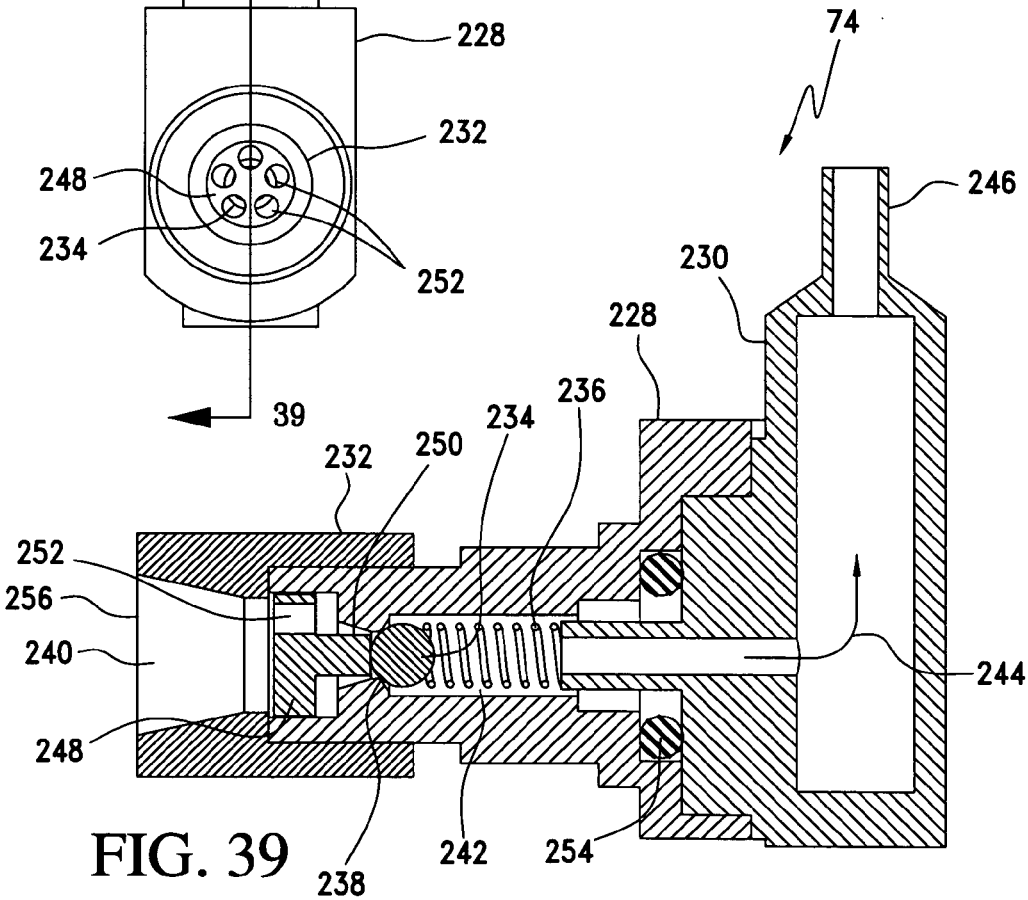
FIG. 39 is an enlarged sectional view taken along line 39—39 of FIG. 38.

Referring now to FIGS. 37–39, the mouth valve 74 will now be described. As shown, the mouth valve 74 includes a body housing 228, a tube housing 230, and a fluid feeding tube 232. A ball valve 234 is biased by spring 236 against an opening 238 in the body housing 228. The opening 238 is in fluid communication with the interior 240 of the tube 232 on one hand, and the recess 242 in the body housing 228, on the other hand. A passageway 244 in the tube housing 230 is in communication with the recess 242 and leads to an outlet 246 which is connected to the fluid inlet tube 102 leading to the tear valve 78 (FIGS. 8 and 36). A valve actuator 248 is positioned upstream of the ball valve 234 and includes a pusher pin 250 in engagement with the ball valve 234. The valve actuator 248 includes preferably a circumferential array of through holes 252 to allow the fluid to flow therethrough from the feeding tube interior 240 to the recess 242, when the pin 250 opens the opening 238 by pushing the ball valve 234 against the force of the spring 236. An O-ring 254 is provided between the body housing 228 and the tube housing 230 to provide a fluid-tight engagement therebetween.

Figure 14:
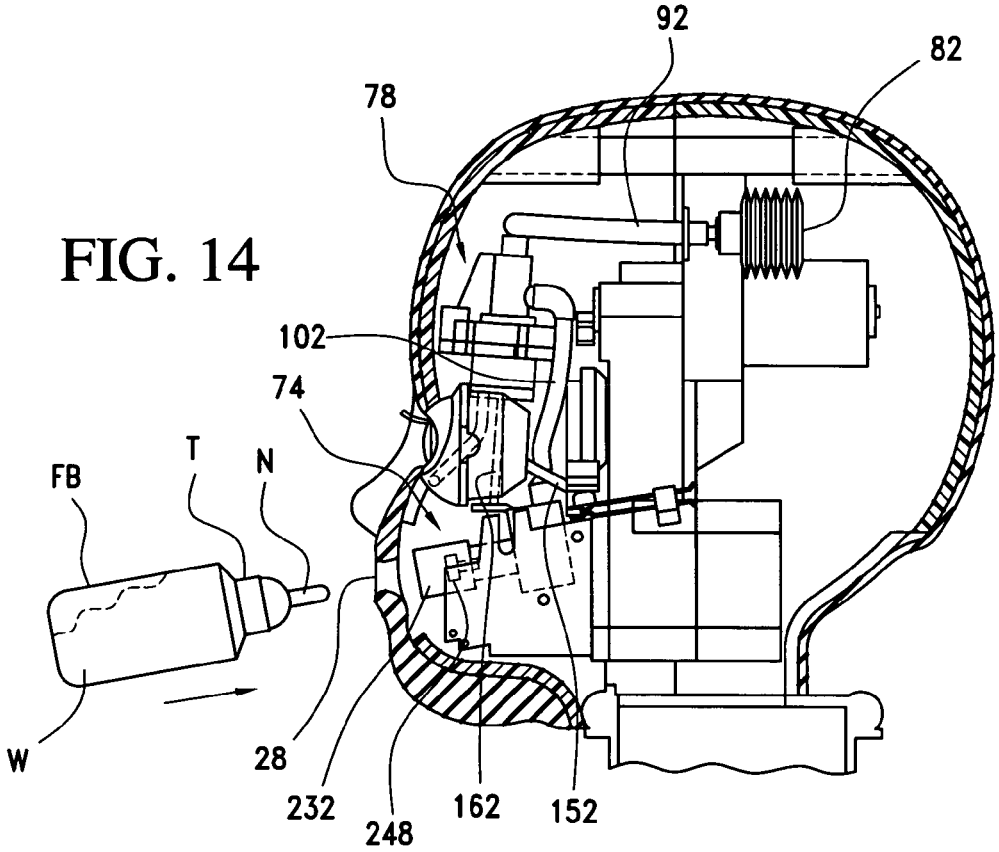
FIGS. 14–15 illustrate the sequence of filling the fluid chamber(s) via the mouth valve.
Figure 15:
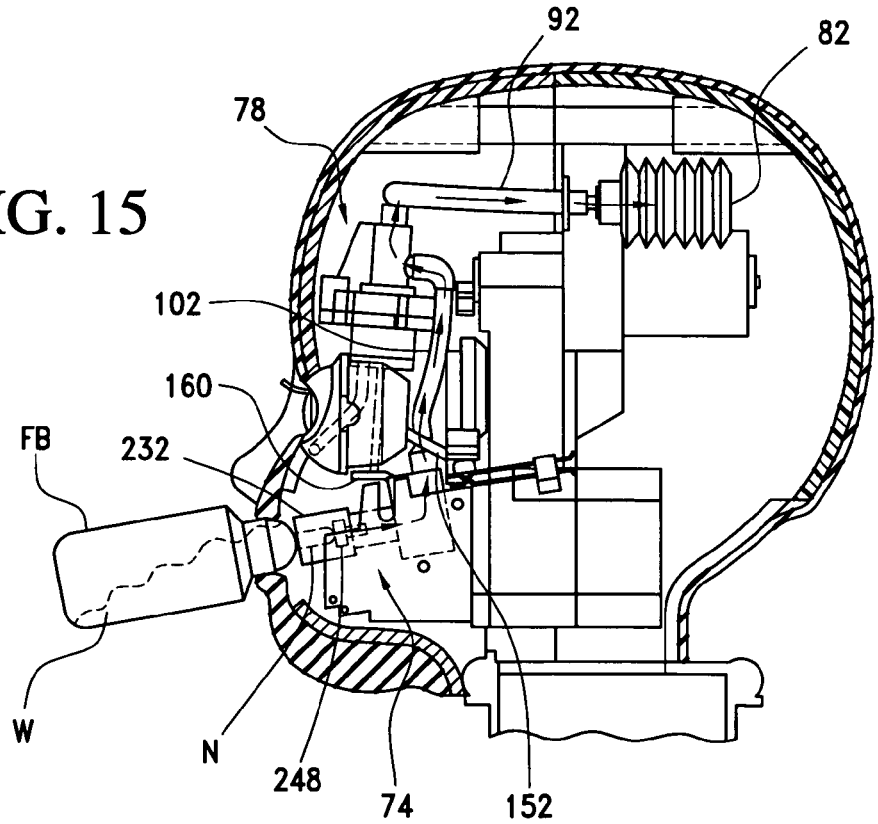

The feeding tube 232 includes an exterior opening 256 for receiving, for example, the top T of a feeding bottle FB for injecting a fluid through the mouth valve 74 to fill the left and right bellows 80 and 82 (FIGS. 14–15). In this regard, it is noted herewith that the mouth valve 74 functions as a one-way valve which, when open, allows the fluid to flow into and through the passageway 244 to the outlet 246, but prevents its backflow. In particular, the mouth valve 74 is opened by applying a pressure on the valve actuator 248, which unseats the ball valve 234 from the opening 238, against the force of the spring 236. When the pressure is released, the ball valve 234 would return to its initial position due to the force of the spring 236, thereby closing the opening 238 and pushing the valve actuator 248 toward the feeding tube 232.

FIGS. 18–29 illustrate a second embodiment of the doll DD with a second embodiment of the tearing mechanism TMM, with the main difference being that the left and right eyes 18 and 20 open and close by gravity and independent of the operation of the tearing mechanism TMM. Accordingly, only the components or features that are different in the second embodiment are described below.

As best shown in FIG. 25, the eye assembly 258 includes left and right eyes 22 and 24, the eye balls of which are connected by a shaft 260. A toggle arm 262, with a weight 264, is affixed to the shaft 260. Due to the weight 264, the toggle arm 262 will point downwardly regardless of the position of the eye assembly 258. As a result, when the doll DD is held in a standing or vertical position, the left and right eyes 22 and 24 will be opened, and when the doll is held in a lying or horizontal position, the left and right eyes 22 and 24 will be closed.

Figure 23:
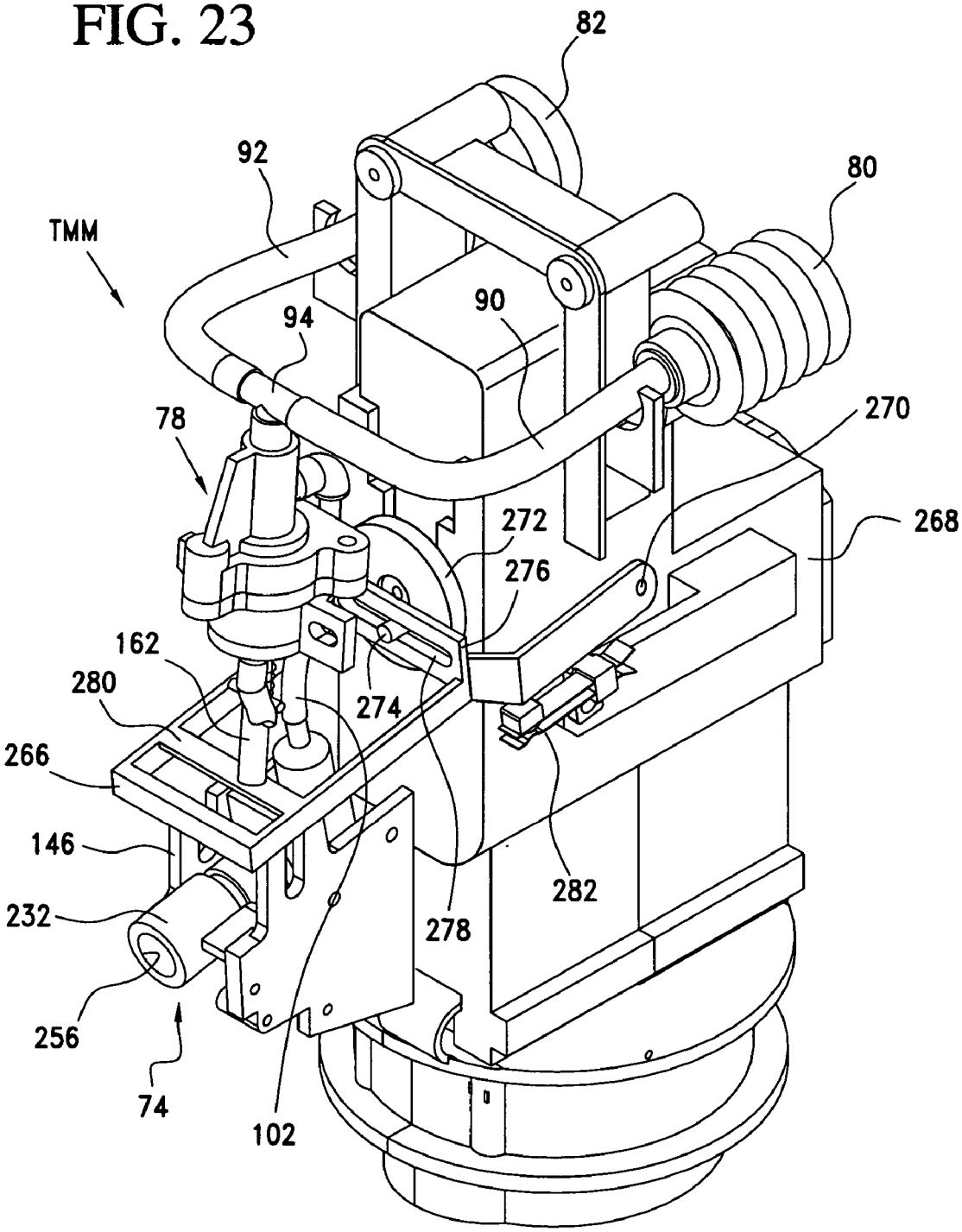
FIG. 23 is a perspective view of the tearing mechanism of FIG. 21, shown without the eye assembly.
Figure 26:
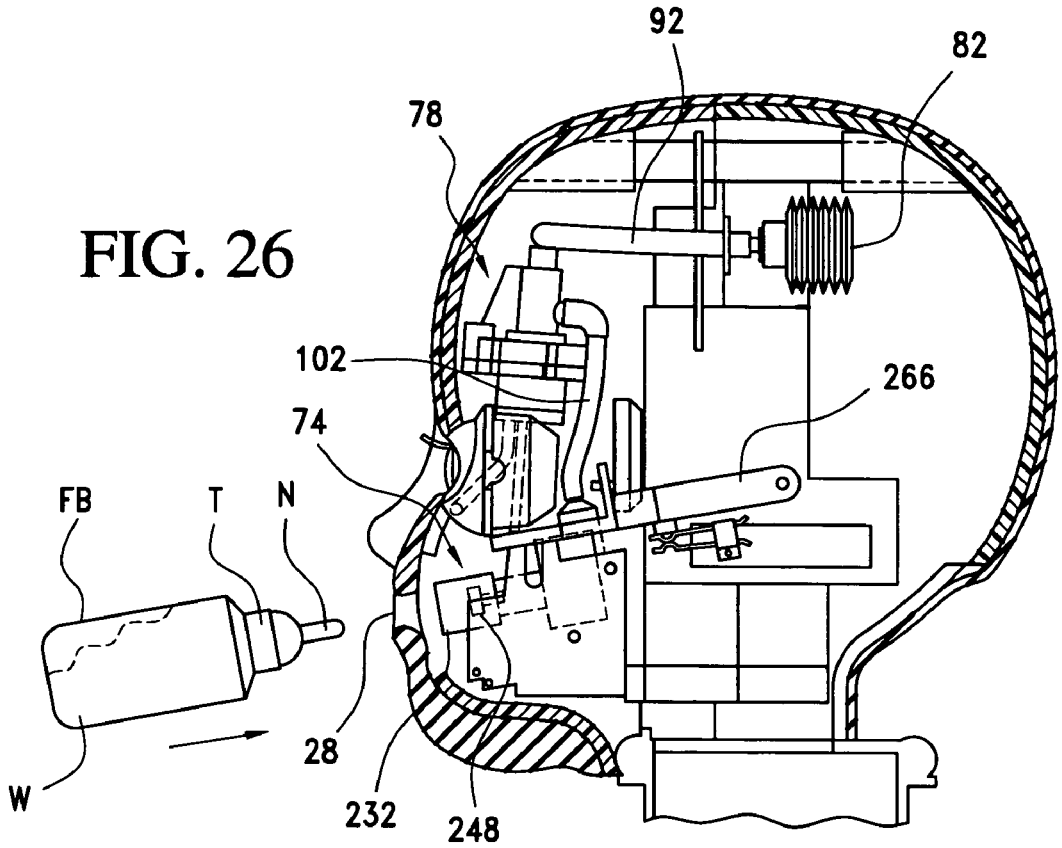
FIGS. 26–27 illustrate the sequence of filling the fluid chamber(s) via the mouth valve in the second embodiment of the doll shown in FIG. 18.
Figure 27:
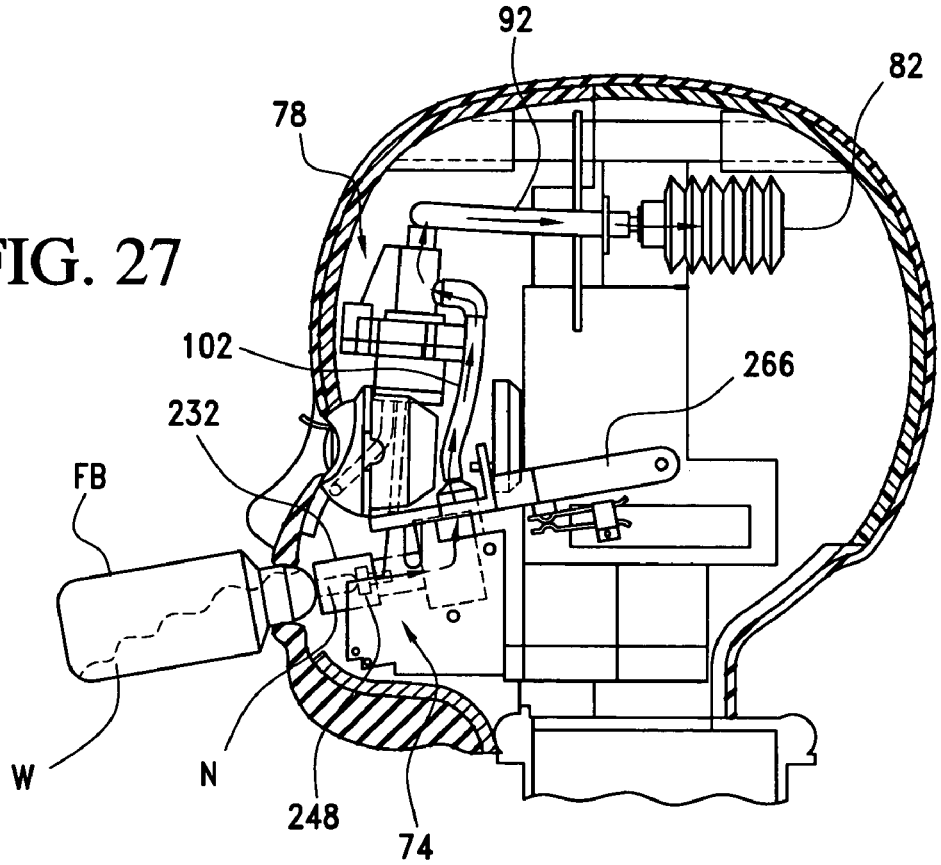
Figure 28:
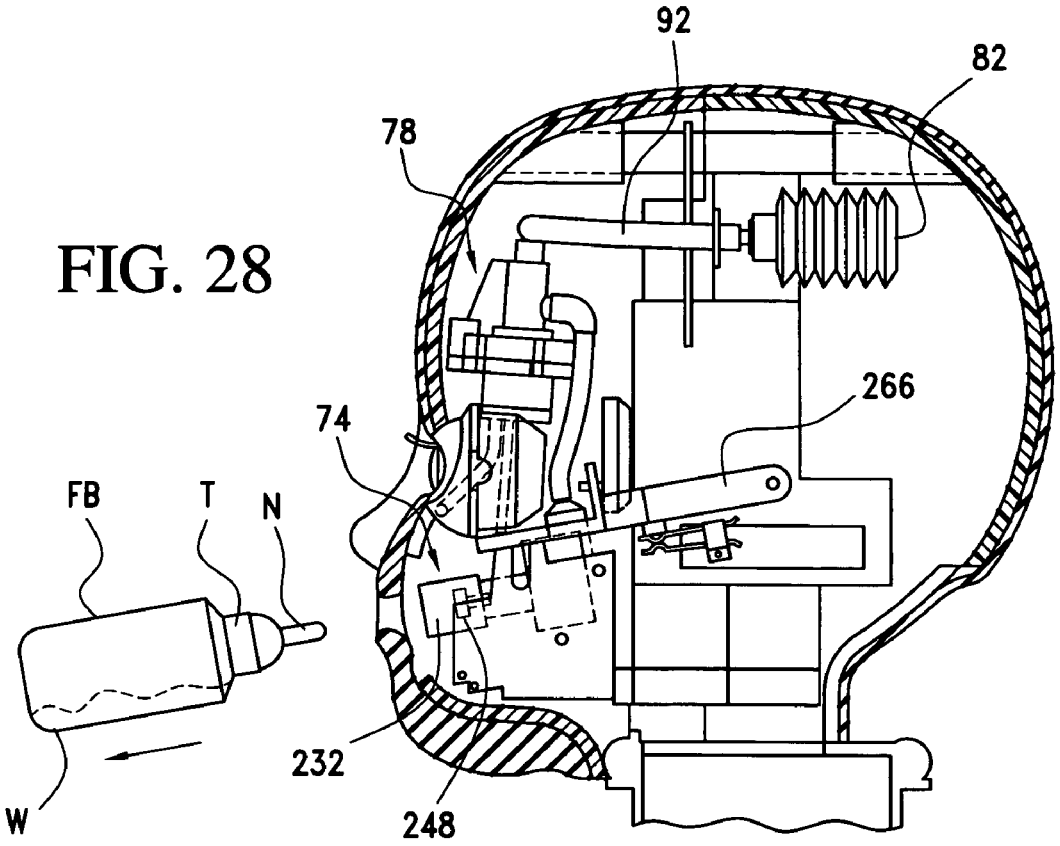
FIGS. 28–29 illustrate the flow of fluid from the fluid chamber(s) to the exterior through the eyes in the form of tears in the second embodiment of the doll shown in FIG. 18.
Figure 29:
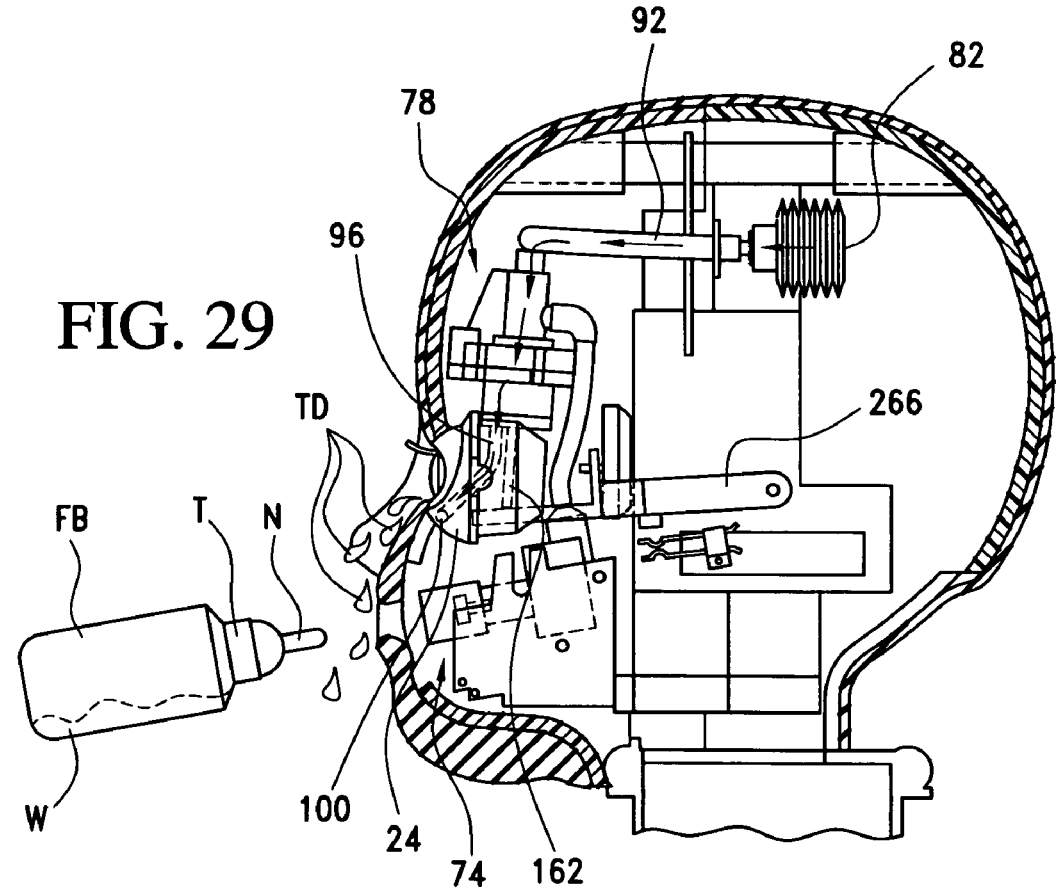

As best shown in FIGS. 23–24, the tearing mechanism TMM includes a tear valve lever 266 pivotally mounted to the housing 268 at 270. The housing accommodates therein a motor (not shown) that drives a cam 272 with a pin 274. The tear valve lever 266 includes a rear pivot plate 276 with a slot 278 for receiving the pin 274. It would be appreciated that when the cam 272 is driven or rotated by the motor, the pin 274 will translate back and forth in the slot 278 and raise or lower the tear valve lever 266.

The tear valve lever 266 includes a tear valve actuator plate 280 in engagement with the tear valve actuator pin 162. A contact switch 282 limits the downward movement of the tear valve lever 266 and communicates the closed position of the tear valve 78 to the motor.

Use and Operation

A basic operation of the tearing mechanism TM in accordance with the first embodiment will now be described by referring to FIGS. 14–16.

In order to prepare the doll D for tearing purposes, a feeding bottle FB containing a fluid, such as water W, is preferably used to fill one or both of the left and right bellows 80 and 82 (FIG. 14). As shown in FIG. 15, the top T of the bottle FB is inserted through the mouth 28 of the doll D, such that the nipple N thereof is pushed into the feeding tube 232 of the mouth valve 74 and engages the valve actuator 248. The bottle FB is inserted further until the valve actuator 248 pushes the ball valve 234 open against the force of the spring 236, and the water W can be injected under pressure, for example, by squeezing the bottle FB. The doll D and the bottle FB are held in this position to keep the mouth valve 74 open, while the water W is being injected. As shown by arrows in FIG. 15, the water W will flow through the mouth valve 74 to the fluid inlet tube 102, to the chamber 216 of the tear valve 78 (FIG. 36). Since in this position, the tear valve 78 is kept in a closed position by the ball valve 212, the water W would flow upwardly through the passageway 201 in the top housing 200, to inside of the tee 94, where it would be distributed to fill the bellows 80 and 82 by the corresponding left and right connector tubes 90 and 92 (FIG. 15). As the bellows 80 and 82 get filled, they expand gradually until full, completely expanded, and fully pressurized due to inherent memory.

Figure 16:
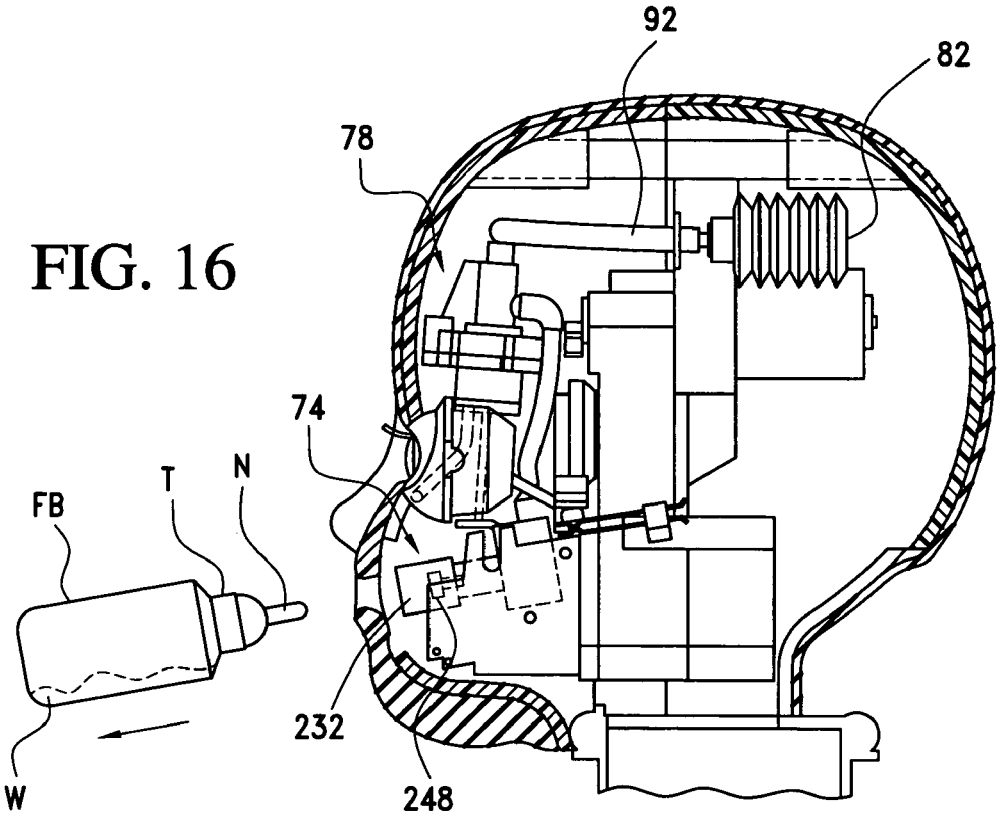
FIGS. 16–17 illustrate the flow of fluid from the fluid chamber(s) to the exterior of the doll through the eyes in the form of tears.

Once one or both of the bellows 80 and 82 are full, the feeding bottle FB is removed from the mouth 28 of the doll D (FIG. 16). As the bottle FB is withdrawn form the doll's mouth 28 (FIG. 16), the force exerted by the nipple N on the valve actuator 248 would be removed, and the ball valve 234 would return to its initial position due to the force exerted by the spring 236, thereby closing the opening 238. As a result, the mouth valve 74 will be closed preventing any backflow of the water W out through the feeding tube 232. The doll D would now be ready to tear.

Figure 17:
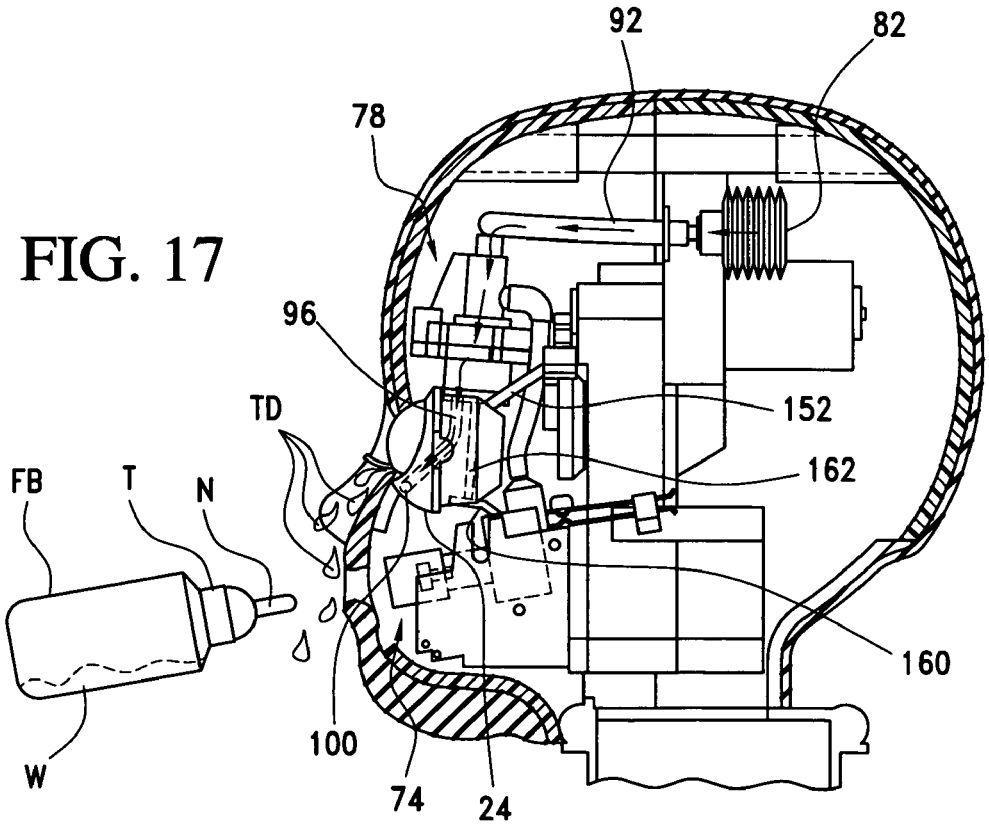
Figure 18:
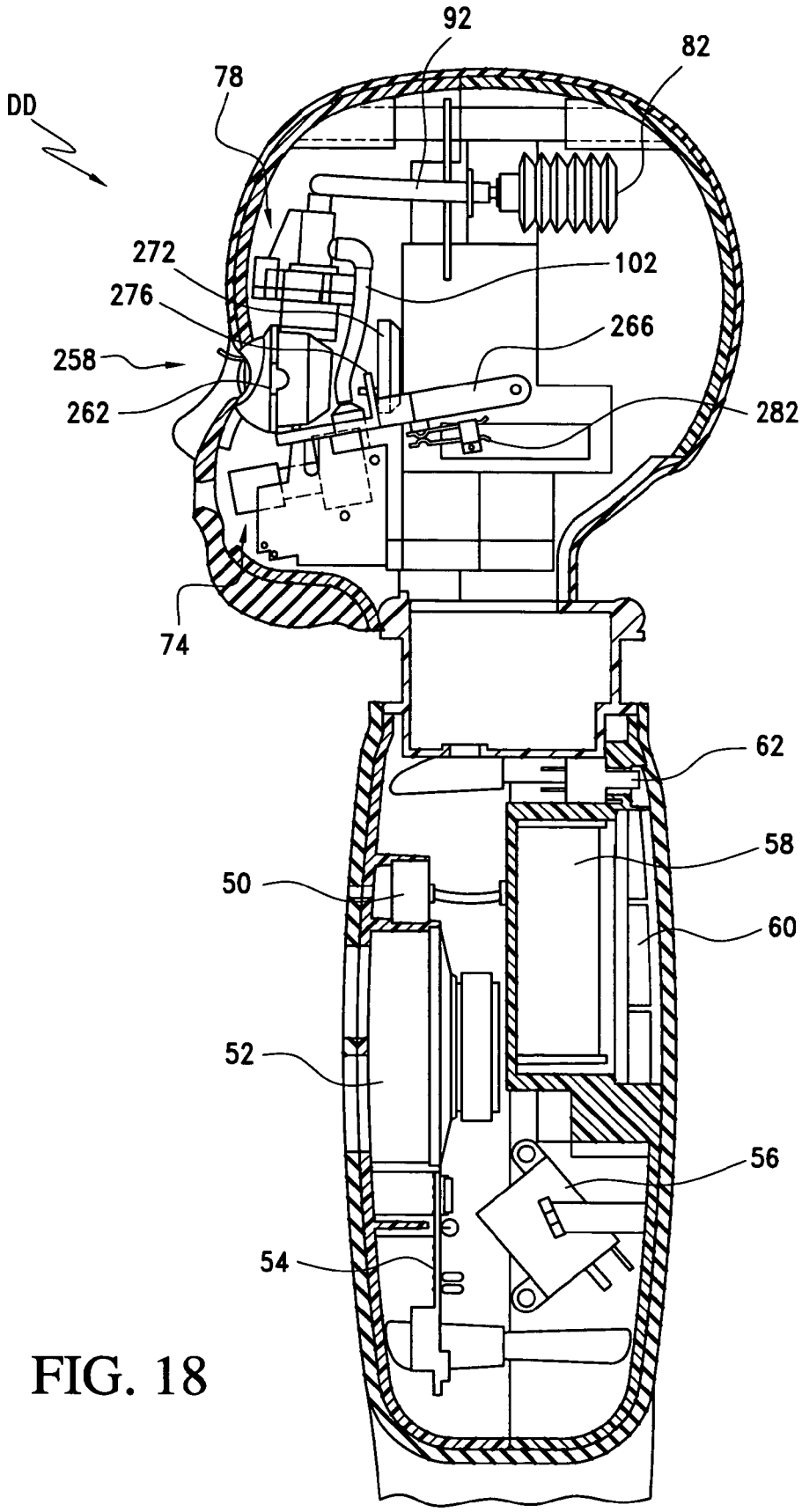
FIG. 18 is a partial side cross-sectional view of a second embodiment of a toy doll in accordance with the present invention.
Figure 19:
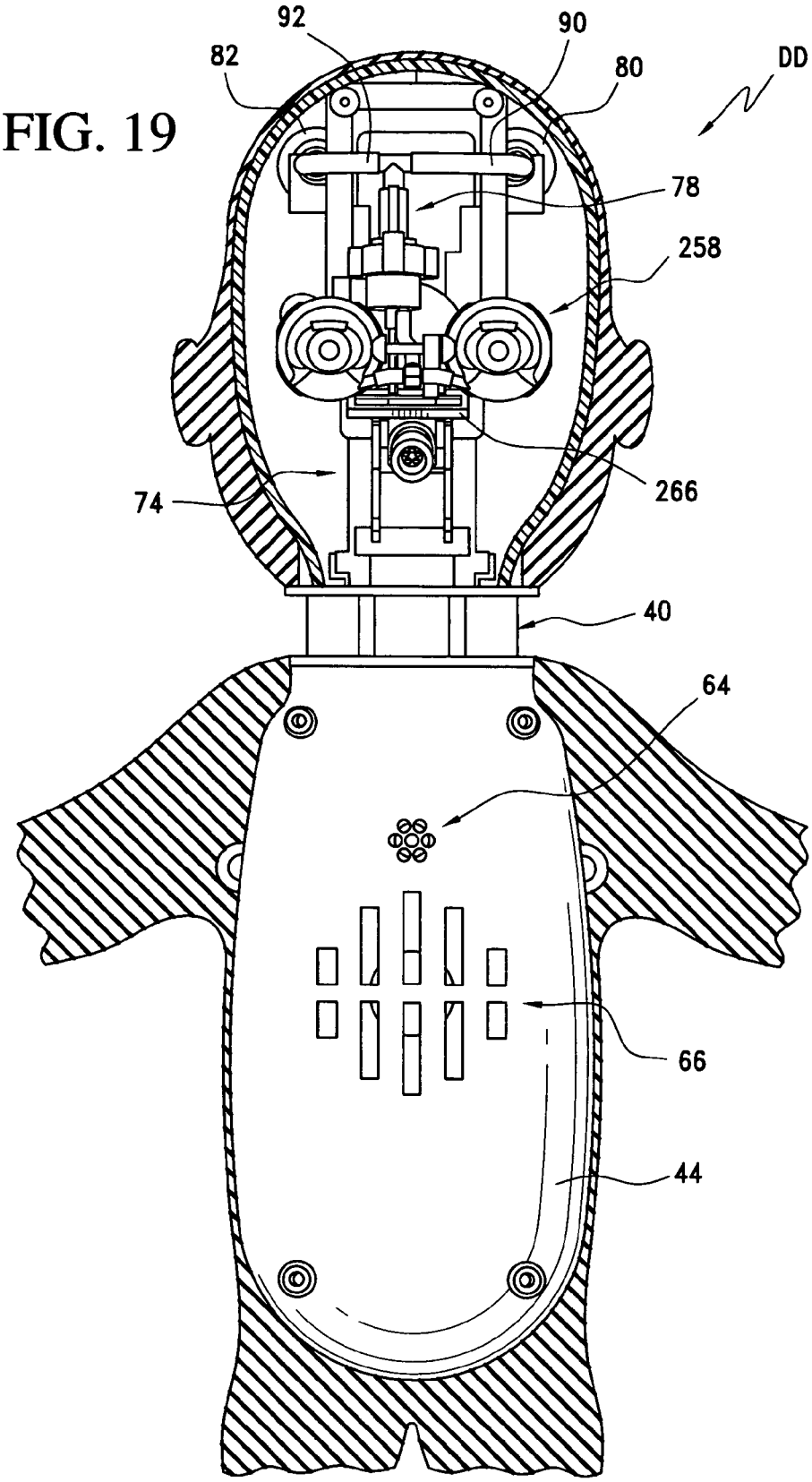
FIG. 19 is a partial front cross-sectional view of the doll shown in FIG. 18.
Figure 20:
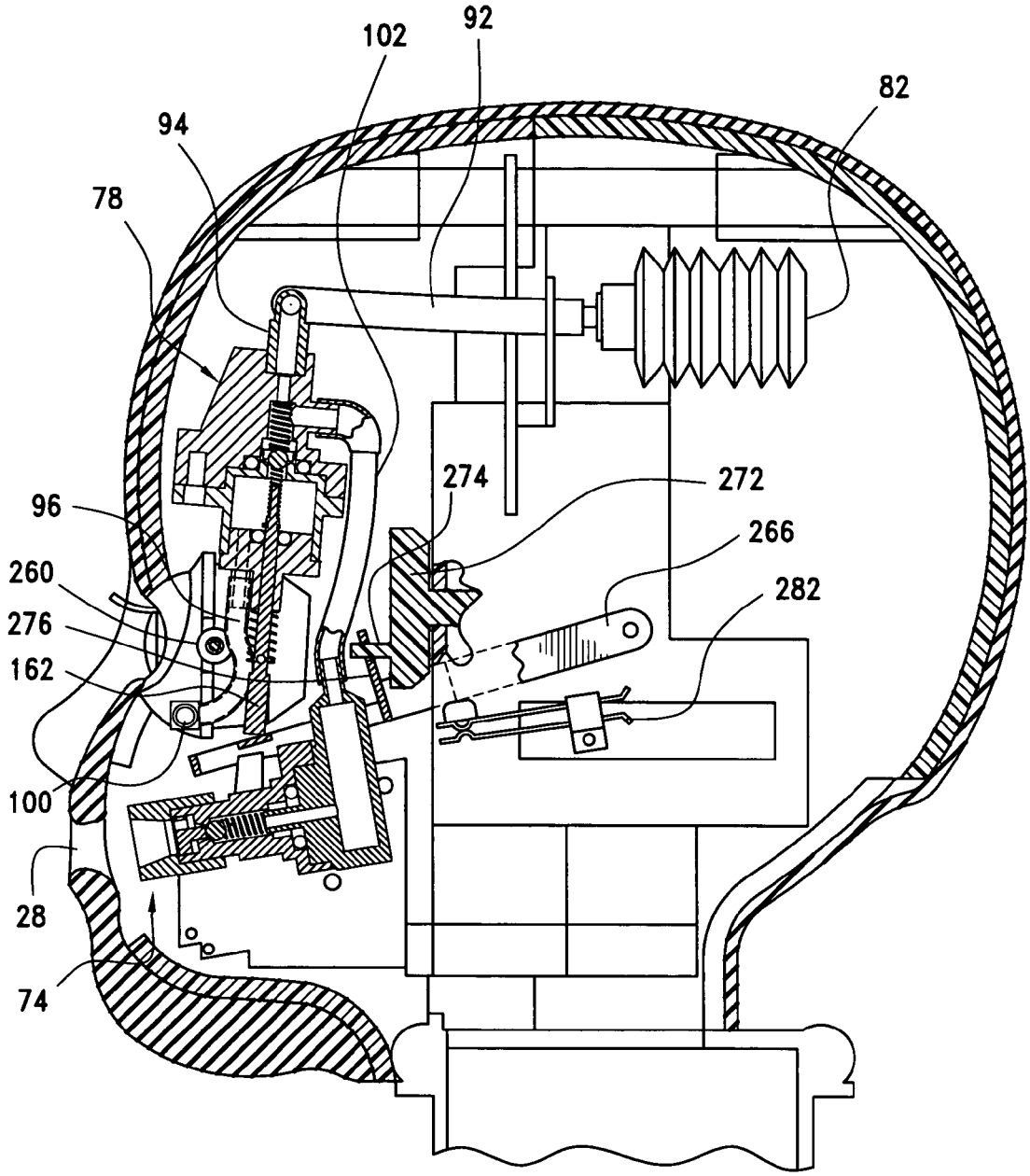
FIG. 20 is an enlarged side cross-sectional view of the head of the doll shown in FIG. 18.
Figure 21:
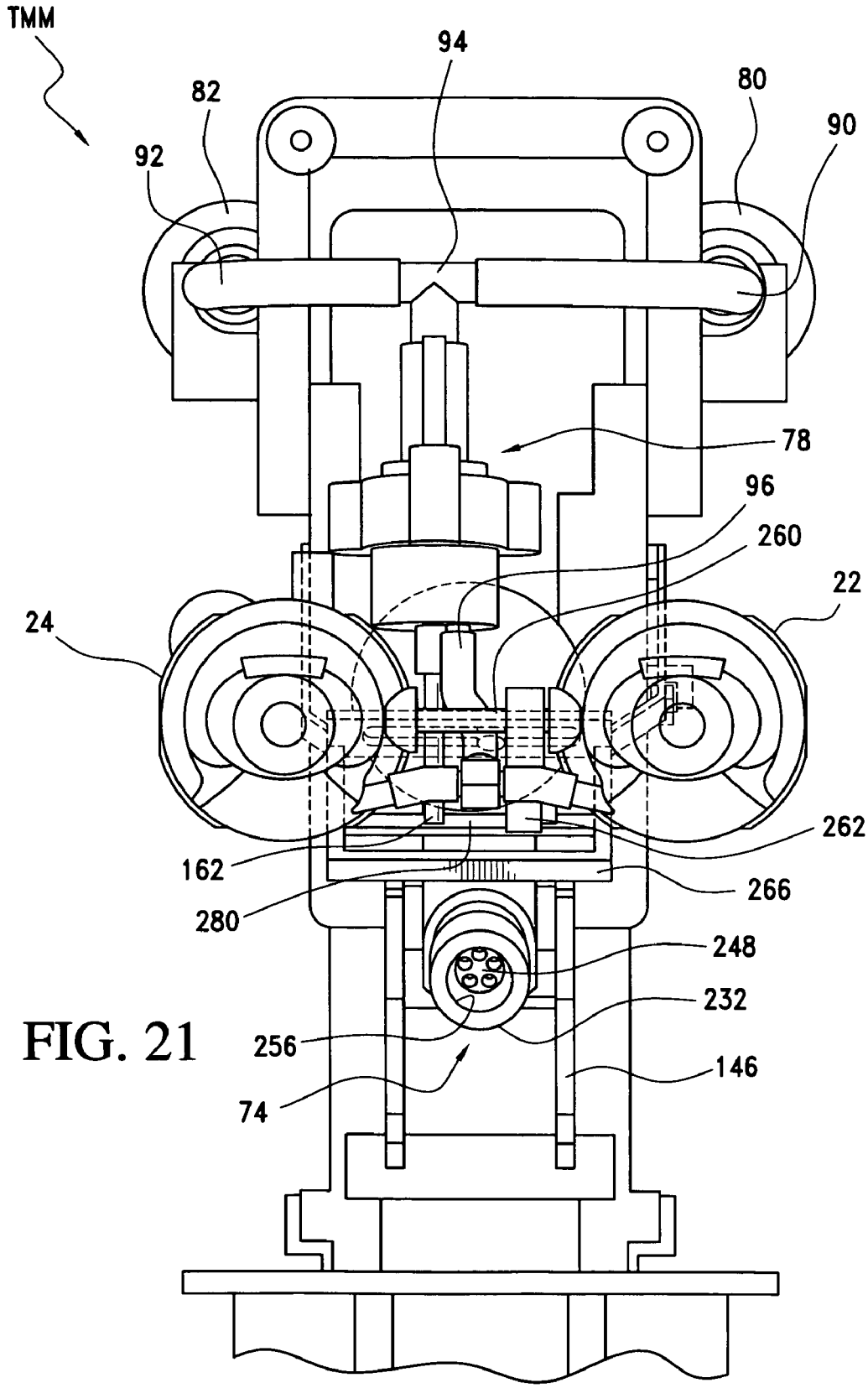
FIG. 21 is an enlarged front elevational view of a second embodiment of the tearing mechanism in accordance with the present invention.
Figure 22:
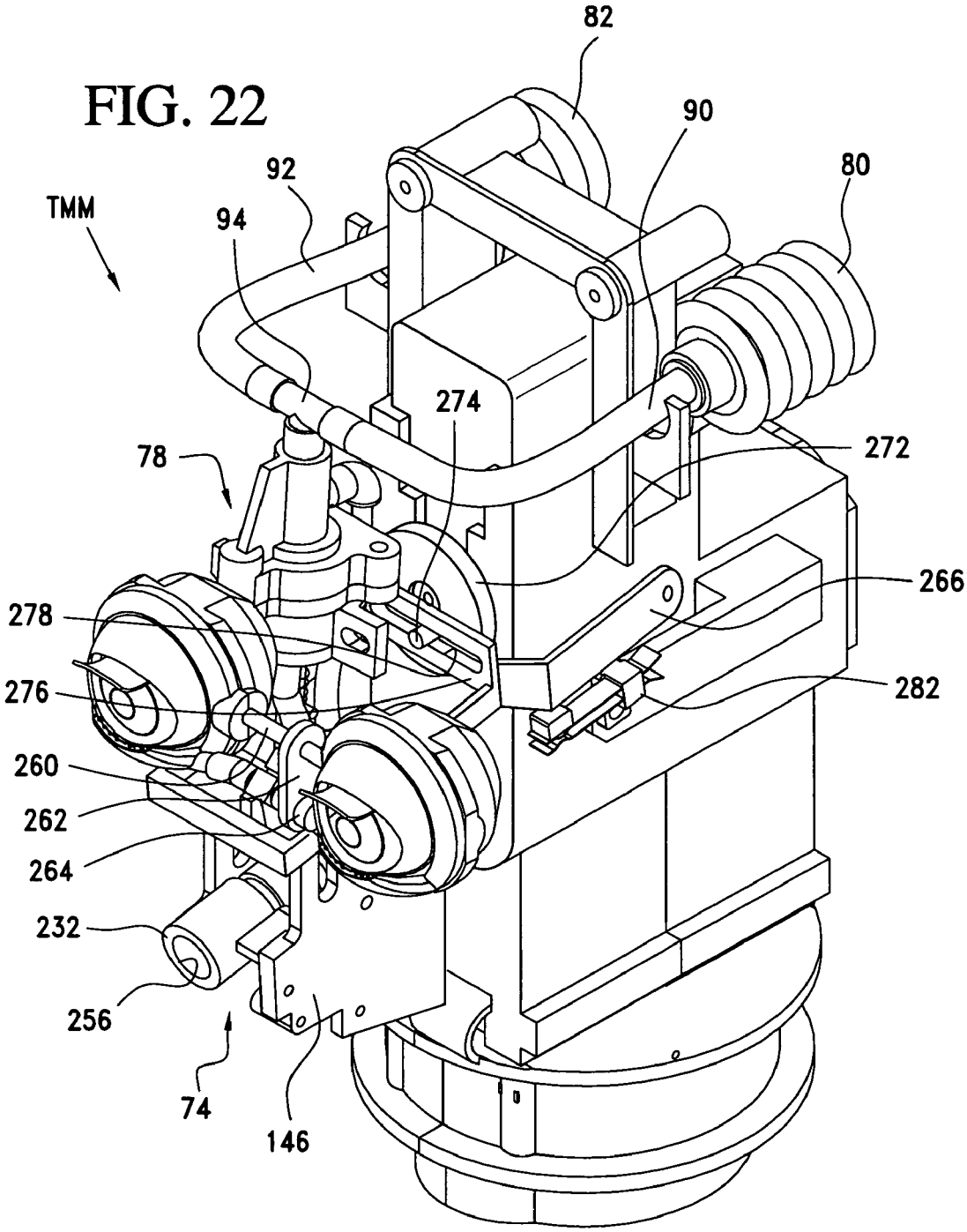
FIG. 22 is a perspective view of the tearing mechanism of FIG. 21, showing the eyes in an open position.

In order to cause the doll D to tear, the motor 106 would be operated in a counterclockwise direction (FIG. 12) to cause the tear valve lever 140 to pivot in a manner that the tear valve actuator plate 160 pushes the tear valve actuator pin 162 upwardly. As the actuator pin 162 moves upwardly, it will open the ball valve 214, thereby allowing the water W, under pressure in the bellows 80 and 82, to flow to the chamber 216 to move downwardly into the recess 206 (FIG. 36). The water W in the recess 206 will then be free to flow downwardly to the left and right eyes 22 and 24 through fluid outlet tube 96 to the left and right tear ducts 98 and 100 and fill up the recesses 176 of the left and right tear caps 174. Any strong or irregular flow of the water W would be retarded or slowed down by the corresponding diffusers 180, and it will then slowly and evenly ooze out of the left and right eyes 22 and 24 in tear-like drops TD (FIG. 17). It is noted that during tearing, the mouth valve 74 is kept in a closed position to prevent any backflow of water therethrough, and any adverse impact on the flow of water through the eyes 22 and 24.

As noted above, moving the valve actuator pin 162 downwardly causes the tear valve 78 to close. Accordingly, the tearing action would stop when the pin 162 is moved downwardly by the action of the tear lever 140.

Although not shown, a microprocessor or the like programmable device would preferably be used to control and coordinate the tearing and opening-closing of the eyes. For instance, the doll D could be programmed in a manner that the eyes are partially or fully closed, or blink during the tearing function. Likewise, the duration, frequency, etc., of the tearing and/or opening-closing of the eyes could be programmed, as desired. In addition, although not shown, an audible mechanism may be incorporated in the doll D to synchronize, for example, a crying sound with the tearing. In this regard, it is noted herewith the foregoing is merely an illustration and the doll D of the invention can be programmed to coordinate and control the tearing and opening-closing of the eyes functions in any way desired.

The basic tearing function of the doll DD of the second embodiment shown in FIGS. 18–29, is similar to the basic procedure described above with regard to the first embodiment. In particular, once one or both of the bellows 80 and 82 have been filed with, for example, water W (FIGS. 26–27), the bottle FB would be removed (FIG. 28) and the motor would be actuated to operate the cam 272, which would then pivot the tear valve lever 266 up to open the tear valve 78 by pushing the tear valve actuator pin 162 upwardly. The water W would flow down from the bellows 80 and 82 to the tear valve 78, to the eyes 22 and 24, and to the exterior in tear-like drops TD (FIG. 29), in the same manner as described above. The doll DD can also be programmed in the same manner as the doll D.

As noted above, since the expandable chambers, such as bellows, inherently tend to retain their shape due to memory, they are gradually pressurized upon expansion or being filled with a fluid. Accordingly, the water W in the bellows 80 and 82 would be subjected to a constant pressure. As a result, only the tear valve 78 need to be actuated to an open position to cause the fluid to flow out through the eyes in the form of tears.

While this invention has been described as having preferred sequences, ranges, steps, materials, structures, components, features, and/or designs, it is understood that it is capable of further modifications, uses and/or adaptations of the invention following in general the principle of the invention, and including such departures from the present disclosure as those come within the known or customary practice in the art to which the invention pertains, and as may be applied to the central features herein before set forth and fall within the scope of the invention and of the limits of the appended claims.

What is claimed is:

1. A tearing mechanism for a toy, comprising:

a) a fluid chamber;

b) a valve in operable communication with said fluid chamber for allowing or restricting the flow of a fluid from the tearing mechanism;

c) a motor operable in first and second generally opposite directions;

d) a valve lever including a first end in operable engagement with said motor and a second end in operable engagement with said valve; and e) said motor being in operable engagement with said valve for actuating said valve in only one of said first and second directions.

2. The tearing mechanism of claim 1, further comprising:

a) a cam driven by said motor for actuating said valve lever; and b) a gear train disposed between said cam and said motor.

3. The tearing mechanism of claim 2, wherein:

a) one of the gears in said gear train comprises a toggle gear; and b) said toggle gear engages said cam when said motor operates in said one of said first and second directions.

4. A tearing mechanism of claim 1, further comprising:

a) an eye in operable engagement with said valve and including an opening for fluid to flow outwardly therefrom.

5. The tearing mechanism of claim 4, wherein:

a) said eye includes a recess for receiving the fluid from said fluid chamber; and b) a fluid diffuser disposed in said recess for retarding the flow of fluid therethrough.

6. The tearing mechanism of claim 5, wherein:

a) said fluid diffuser comprises a porous material.

7. The tearing mechanism of claim 1, wherein:

a) said one of said first and second directions comprises a counterclockwise direction.

8. The tearing mechanism of claim 1, further comprising:

a) a mouth valve for supplying a fluid to said fluid chamber.

9. The tearing mechanism of claim 1, wherein:

a) said fluid chamber comprises a bellows extending generally horizontally between the front and rear of the tearing mechanism.

10. The tearing mechanism of claim 9, wherein:

a) two of said bellows are in fluid communication with said valve; and b) said bellows are self-pressurized when filled with a fluid.

11. The tearing mechanism of claim 1, wherein:

a) said fluid chamber comprises an expandable chamber.

12. The tearing mechanism for a toy, comprising:

a) a fluid chamber b) a valve in operable communication with said fluid chamber for allowing or restricting the flow of a fluid from the tearing mechanism;

c) an eye lever for opening or closing an eye;

d) a motor for actuating one of said valve and said eye lever;

e) a valve lever including a first end in operable engagement with said motor and a second end in operable engagement with said valve; and f) said eye lever including a first end in operable engagement with said motor and a second end in operable engagement with the eye.

13. The tearing mechanism of claim 12, wherein:

a) said motor actuates both of said valve and said eye lever.

14. The tearing mechanism of claim 13, wherein:

a) said motor is operable in first and second generally opposite directions; and b) said motor actuates said valve only in one of said first and second directions.

15. The tearing mechanism of claim 14, wherein:

a) said motor actuates said eye lever in both of said first and second directions.

16. The tearing mechanism of claim 14, wherein:

a) said one of said first and second directions comprises a counterclockwise direction.

17. The tearing mechanism of claim 12, further comprising:

a) a first cam driven by said motor for actuating said valve lever; and b) a gear train disposed between said first cam and said motor.

18. The tearing mechanism of claim 17, wherein:

a) one of the gears in said gear train comprises a toggle gear; and b) said motor actuates said valve when said toggle gear engages said first cam.

19. The tearing mechanism of claim 18, further comprising:

a) a second cam driven by said motor for actuating said eye lever; and b) a gear disposed between said second cam and said motor.

20. The tearing mechanism of claim 19, wherein:

a) said motor actuates both of said valve lever and said eye lever.

21. The tearing mechanism of claim 12, further comprising:

a) an eye actuator arm disposed between the eye and said second end of said eye lever.

22. The tearing mechanism of claim 21, further comprising:

a) said eye actuator arm pivots two of the eyes open and closed when said eye lever is actuated by said motor.

23. The tearing mechanism of claim 21, further comprising:

a) first and second switches for limiting actuation of said eye lever between two predetermined positions; and b) the positions corresponding to open and closed positions of the eye.

24. A tearing mechanism of claim 12, further comprising:

a) an eye in operable engagement with said valve and including an opening for fluid to flow outwardly therefrom.

25. The tearing mechanism of claim 24, wherein:

a) said eye includes a recess for receiving the fluid from said fluid chamber; and b) a fluid diffuser disposed in said recess for retarding the flow of fluid therethrough.

26. The tearing mechanism of claim 25, wherein:

a) said fluid diffuser comprises a porous material.

27. The tearing mechanism of claim 12, further comprising:

a) a mouth valve for supplying a fluid to said fluid chamber.

28. The tearing mechanism of claim 12, wherein:

a) said fluid chamber comprises a bellows extending generally horizontally between the front and rear of the tearing mechanism.

29. The tearing mechanism of claim 28, wherein:

a) two of said bellows are in fluid communication with said valve; and b) said bellows are self-pressurized when filled with a fluid.

30. A tearing mechanism for a toy, comprising:

a) a fluid chamber;

b) a valve in operable communication with said fluid chamber for allowing or restricting the flow of a fluid from the tearing mechanism;

c) a motor for actuating said valve;

d) an eye including an opening for fluid to flow outwardly therefrom;

e) a gravity-controlled mechanism comprising a weighted toggle arm for opening or closing said eye;

f) a valve lever including a first end in operable engagement with said motor and a second end in operable engagement with said valve; and g) a cam driven by said motor for actuating said valve lever.

31. The tearing mechanism of claim 30, further comprising:

a) a switch for limiting actuation of said valve lever to a predetermined position; and b) the position corresponding to a closed position of said valve.

32. The tearing mechanism of claim 30, wherein:

a) said fluid chamber comprises an expandable chamber.

33. The tearing mechanism of claim 30, wherein:

a) said fluid chamber comprises a bellows.

34. The tearing mechanism of claim 33, wherein:

a) two of said bellows are in fluid communication with said valve.

35. The tearing mechanism of claim 33, wherein:

a) said bellows is self-pressurized when filled with a fluid.

36. A tearing mechanism for a toy, comprising:

a) a fluid chamber;

b) a valve in operable communication with said fluid chamber for allowing or restricting the flow of a fluid from the tearing mechanism;

c) a motor for actuating said valve;

d) an eye including an opening for the fluid to flow outwardly therefrom;

e) said eye including a recess for receiving the fluid from said fluid chamber; and f) a fluid diffuser disposed in said recess for retarding the flow of fluid therethrough.

37. The tearing mechanism of claim 36, further comprising:

a) said fluid diffuser comprises a porous material.

38. The tearing mechanism of claim 36, further comprising:

a) a valve lever including a first end in operable engagement with said motor and a second end in operable engagement with said valve; and b) a cam driven by said motor for actuating said valve lever.

39. The tearing mechanism of claim 38, further comprising:

a) a switch for limiting actuation of said valve lever to a predetermined position; and b) the position corresponding to a closed position of said valve.

40. The tearing mechanism of claim 36, further comprising:

a) a mouth valve for supplying a fluid to said fluid chamber.

41. The tearing mechanism of claim 40, wherein:

a) said fluid chamber comprises a bellows extending generally horizontally between the front and rear of the tearing mechanism.

42. The tearing mechanism of claim 41, wherein:

a) two of said bellows are in fluid communication with said valve.

43. The tearing mechanism of claim 42, wherein:

a) said bellows are self-pressurized when filled with a fluid.

44. A tearing mechanism for a toy, comprising:

a) a fluid chamber;

b) a valve in operable communication with said fluid chamber for allowing or restricting the flow of a fluid from the tearing mechanism;

c) an eye lever for opening or closing an eye;

d) a motor for actuating said eye lever;

e) said eye lever including a first end in operable engagement with said motor and a second end disposed adjacent the eye;

f) first and second magnetically attracting members; and g) said second end including one of said first and second magnetically attracting members and the eye including the other of said first and second magnetically attracting members.

45. An eye opening or closing mechanism for a toy, comprising:

a) an eye lever for opening or closing an eye;

b) a motor for actuating said eye lever;

c) said eye lever including a first end in operable engagement with said motor and a second end disposed adjacent the eye;

d) first and second magnetically attracting members; and e) said second end including one of said first and second magnetically attracting members and the eye including the other of said first and second magnetically attracting members.

46. A fluid dispensing mechanism for a figure, comprising:

a) a fluid chamber;

b) a valve in operable communication with said fluid chamber for allowing or restricting the flow of a fluid from the dispensing mechanism;

c) a motor operable in first and second generally opposite directions;

d) a valve lever including a first end in operable engagement with said motor and a second end in operable engagement with said valve; and e) said motor being in operable engagement with said valve for actuating said valve in only one of said first and second directions.

47. A method of causing a toy to tear, comprising:

a) providing a tearing mechanism, comprising:

i) a fluid chamber;

ii) a fluid valve in operable communication with the fluid chamber for allowing or restricting the flow of a fluid from the tearing mechanism;

iii) a motor operable in first and second generally opposite directions; and iv) the motor being in operable engagement with the fluid valve for actuating the valve in only one of the first and second directions;

b) supplying a fluid to the fluid chamber via a mouth valve in the toy;

c) actuating the fluid valve by operating the motor in the one of the first and second directions; and d) allowing the fluid to flow out of one of the eyes of the toy.

48. The method of claim 47, further comprising:

e) partially or completing closing the eyes substantially simultaneously with the step d) to simulate crying.

49. A tearing mechanism for a toy, comprising:

a) a fluid chamber;

b) a valve in operable communication with said fluid chamber for allowing or restricting the flow of a fluid from the tearing mechanism;

c) a motor operable in first and second generally opposite directions;

d) an eye lever for opening or closing an eye; and e) said eye lever including a first end in operable engagement with said motor and a second end in operable engagement with the eye;

f) said motor being in operable engagement with said valve for actuating said valve in only one of said first and second directions.

50. The tearing mechanism of claim 49, wherein:

a) said motor actuates said eye lever in both of said first and second directions for opening or closing the eye.

51. The tearing mechanism of claim 50, further comprising:

a) first and second switches for limiting actuation of said eye lever between two predetermined positions; and b) the positions corresponding to open and closed positions of the eye.

52. The tearing mechanism of claim 49, further comprising:

a) a cam driven by said motor for actuating said eye lever; and b) a gear disposed between said cam and said motor.

53. The tearing mechanism of claim 52, wherein:

a) said motor actuates said eye lever in both of first and second directions for opening or closing the eye.

54. The tearing mechanism of claim 49, further comprising:

a) an eye actuator arm disposed between the eye and said second end of said eye lever.

55. The tearing mechanism of claim 54, wherein:

a) said eye actuator arm pivots two of the eyes open and closed when said eye lever is actuated by said motor.

56. The tearing mechanism of claim 49, wherein:

a) said fluid chamber comprises an expandable chamber.

57. A tearing mechanism for a toy, comprising:

a) a fluid chamber;

b) a valve in operable communication with said fluid chamber for allowing or restricting the flow of a fluid from the tearing mechanism;

c) a motor for actuating said valve;

d) an eye including an opening for fluid to flow outwardly therefrom;

e) a gravity-controlled mechanism for opening or closing said eye;

f) said eye including a recess for receiving the fluid from said fluid chamber; and g) a fluid diffuser disposed in said recess for retarding the flow of fluid therethrough.

58. The tearing mechanism of claim 57, wherein:

a) said fluid diffuser comprises a porous material.

59. The tearing mechanism of claim 57, further comprising:

a) a mouth valve for supplying a fluid to said fluid chamber.

60. The tearing mechanism of claim 59, wherein:

a) said fluid chamber comprises a bellows extending generally horizontally between the front and rear of the tearing mechanism.

61. The tearing mechanism of claim 60, wherein:

a) two of said bellows are in fluid communication with said valve.

62. The tearing mechanism of claim 61, wherein:

a) said bellows are self-pressurized when filled with a fluid.

63. A toy including a tearing mechanism, the tearing mechanism comprising:

a) a fluid chamber;

b) a valve in operable communication with said fluid chamber for allowing or restricting the flow of a fluid from the tearing mechanism;

c) a motor operable in first and second generally opposite directions;

d) a valve lever including a first end in operable engagement with said motor and a second end in operable engagement with said valve; and e) said motor being in operable engagement with said valve for actuating said valve in only one of said first and second directions.

64. A toy including a tearing mechanism, the tearing mechanism comprising:

a) a fluid chamber;

b) a valve in operable communication with said fluid chamber for allowing or restricting the flow of a fluid from the tearing mechanism;

c) an eye lever for opening or closing an eye;

d) a motor for actuating one of said valve and said eye lever;

e) a valve lever including a first end in operable engagement with said motor and a second end in operable engagement with said valve; and f) said eye lever including a first end in operable engagement with said motor and a second end in operable engagement with the eye.

65. A toy including a tearing mechanism, the tearing mechanism comprising:

a) a fluid chamber;

b) a valve in operable communication with said fluid chamber for allowing or restricting the flow of a fluid from the tearing mechanism;

c) a motor for actuating said valve;

d) an eye including an opening for fluid to flow outwardly therefrom;

e) a gravity-controlled mechanism comprising a weighted toggle arm for opening or closing said eye;

f) a valve lever including a first end in operable engagement with said motor and a second end in operable engagement with said valve; and g) a cam driven by said motor for actuating said valve lever.

66. A toy including a tearing mechanism, the tearing mechanism comprising:

a) a fluid chamber;

b) a valve in operable communication with said fluid chamber for allowing or restricting the flow of a fluid from the tearing mechanism;

c) a motor for actuating said valve;

d) an eye including an opening for the fluid to flow outwardly therefrom;

e) said eye including a recess for receiving the fluid from said fluid chamber; and f) a fluid diffuser disposed in said recess for retarding the flow of fluid therethrough.

67. A toy including a tearing mechanism, the tearing mechanism comprising:

a) a fluid chamber;

b) a valve in operable communication with said fluid chamber for allowing or restricting the flow of a fluid from the tearing mechanism;

c) an eye lever for opening or closing an eye;

d) a motor for actuating said eye lever;

e) said eye lever including a first end in operable engagement with said motor and a second end disposed adjacent the eye;

f) first and second magnetically attracting members; and g) said second end including one of said first and second magnetically attracting members and the eye including the other of said first and second magnetically attracting members.

68. A toy including an eye opening or closing mechanism, the eye opening or closing mechanism comprising:

a) an eye lever for opening or closing an eye;

b) a motor for actuating said eye lever;

c) said eye lever including a first end in operable engagement with said motor and a second end disposed adjacent the eye;

d) first and second magnetically attracting members; and e) said second end including one of said first and second magnetically attracting members and the eye including the other of said first and second magnetically attracting members.

69. A figure including a fluid dispensing mechanism, the fluid dispensing mechanism comprising:

a) a fluid chamber;

b) a valve in operable communication with said fluid chamber for allowing or restricting the flow of a fluid from the dispensing mechanism;

c) a motor operable in first and second generally opposite directions;

d) a valve lever including a first end in operable engagement with said motor and a second end in operable engagement with said valve; and e) said motor being in operable engagement with said valve for actuating said valve in only one of said first and second directions.

* * * * *